US007395674B2

(12) United States Patent
Honda

(10) Patent No.: US 7,395,674 B2
(45) Date of Patent: Jul. 8, 2008

(54) AIR CONDITIONER

(75) Inventor: Masahiro Honda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 312 days.

(21) Appl. No.: 10/578,674

(22) PCT Filed: Jun. 30, 2005

(86) PCT No.: PCT/JP2005/012029

§ 371 (c)(1),
(2), (4) Date: May 9, 2006

(87) PCT Pub. No.: WO2006/003967

PCT Pub. Date: Jan. 12, 2006

(65) Prior Publication Data

US 2007/0130978 A1 Jun. 14, 2007

(30) Foreign Application Priority Data

Jul. 1, 2004 (JP) ..... 2004-195229

(51) Int. Cl.
*F25B 27/00* (2006.01)

(52) U.S. Cl. ..... 62/196.4; 62/199; 62/238.7; 62/513

(58) Field of Classification Search ..... 62/238.6–238.7, 62/199–200, 196.4, 513
See application file for complete search history.

(56) References Cited

U.S. PATENT DOCUMENTS 4,270,359 A * 6/1981 Hummel ..... 62/235.1
6,079,218 A * 6/2000 Ueda ..... 62/160
6,935,421 B2 * 8/2005 Takeuchi et al. ..... 165/202
7,028,767 B2 * 4/2006 Takano et al. ..... 165/202

FOREIGN PATENT DOCUMENTS

| | | |
|---|---|---|
| JP | 63-204074 A | 8/1988 |
| JP | 03-129259 A | 6/1991 |
| JP | 03-129260 A | 6/1991 |
| JP | 03-260561 A | 11/1991 |
| JP | 05-45022 A | 2/1993 |
| JP | 07-120076 A | 5/1995 |

* cited by examiner

*Primary Examiner*—William E Tapolcai
(74) *Attorney, Agent, or Firm*—Global IP Counselors

(57) ABSTRACT

An air conditioner has a heat source refrigerant circuit, utilization refrigerant circuits, a pressurizing circuit, and a cooler. The heat source refrigerant circuit is configured by an interconnection of a compression mechanism, a heat source heat exchanger, and a heat source expansion valve that reduces a pressure of refrigerant condensed in the heat source heat exchanger. The pressurizing circuit is disposed in the heat source refrigerant circuit and causes high-pressure gas refrigerant compressed in the compression mechanism to merge with a refrigerant having a pressure that is reduced in the heat source expansion valve. The refrigerant is sent to the utilization refrigerant circuits. The cooler cools the refrigerant having the pressure that is reduced in the heat source expansion valve.

8 Claims, 14 Drawing Sheets

AIR CONDITIONER

CROSS-REFERENCE TO RELATED APPLICATIONS

This U.S. National stage application claims priority under 35 U.S.C. §119(a) to Japanese Patent Application No. 2004-195229, filed in Japan on Jul. 1, 2004 the entire contents of which are hereby incorporated herein by reference.

TECHNICAL FIELD

The present invention relates to an air conditioner, and in particular to an air conditioner disposed with a heat source refrigerant circuit and utilization refrigerant circuits connected to the heat source refrigerant circuit.

BACKGROUND ART

Conventionally, there has been a refrigerating apparatus disposed with a vapor compression-type refrigerant circuit including a heat exchanger configured such that refrigerant flows in from below and flows out from above as an evaporator of the refrigerant (e.g., see Japanese Patent Application Publication No. S63-204074). In order to prevent refrigerating machine oil from accumulating inside the evaporator, the refrigerating apparatus is configured to extract, from the vicinity of the surface of the refrigerant, the refrigerating machine oil accumulating in a state where it floats on the surface of the refrigerant as a result of the refrigerating machine oil and the refrigerant separating into two layers because the specific gravity of the refrigerating machine oil is smaller than that of the refrigerant, and to return the refrigerating machine oil to the intake side of the compressor.

Further, as an example of a refrigerating apparatus disposed with a vapor compression-type refrigerant circuit, there is an air conditioner disposed with a vapor compression-type refrigerant circuit including: a heat source refrigerant circuit including plural heat source heat exchangers; and plural utilization refrigerant circuits connected to the heat source refrigerant circuit (e.g., see Japanese Patent Application Publication No. H03-260561). In this air conditioner, heat source expansion valves are disposed so that the flow rate of the refrigerant flowing into the heat source heat exchangers can be regulated. Additionally, in this air conditioner, when the heat source heat exchangers are caused to function as evaporators during a heating operation or during a simultaneous cooling and heating operation, for example, control is conducted to reduce the evaporating ability by reducing the openings of the heat source expansion valves as the overall air conditioning load of the plural utilization refrigerant circuits becomes smaller. Moreover, when the overall air conditioning load of the plural utilization refrigerant circuits becomes extremely small, control is conducted to reduce the evaporating ability by closing some of the plural heat source expansion valves to reduce the number of heat source heat exchangers functioning as evaporators or to reduce the evaporating ability by causing some of the plural heat source heat exchangers to function as condensers to offset the evaporating ability of the heat source heat exchangers functioning as evaporators.

Further, in the aforementioned air conditioner, when the heat source heat exchangers are caused to function as condensers during a cooling operation or during the simultaneous cooling and heating operation, control is conducted to reduce the condensing ability by increasing the amount of liquid refrigerant accumulating inside the heat source heat exchangers and reducing the substantial heat transfer area by reducing the openings of the heat source expansion valves connected to the heat source heat exchangers as the overall air conditioning load of the plural utilization refrigerant circuits becomes smaller. However, when control is conducted to reduce the openings of the heat source expansion valves, there is the problem that there is a tendency for the refrigerant pressure downstream of the heat source expansion valves (specifically, between the heat source expansion valves and the plural utilization refrigerant circuits) to drop and become unstable, and control to reduce the condensing ability of the heat source refrigerant circuit cannot be stably conducted. In order to counter this problem, control has been proposed to raise the refrigerant pressure downstream of the heat source expansion valves by disposing a pressurizing circuit that causes high-pressure gas refrigerant compressed by the compressor to merge with refrigerant whose pressure has been reduced in the heat source expansion valves and is sent to the utilization refrigerant circuits (e.g., see Japanese Patent Application Publication No. H03-129259).

SUMMARY OF THE INVENTION

In the aforementioned air conditioner, there are cases where a heat exchanger such as a plate heat exchanger configured such that the refrigerant flows in from below and flows out from above when functioning as an evaporator of the refrigerant is used as the heat source heat exchangers. In these cases, in order to prevent the refrigerating machine oil from accumulating inside the heat source heat exchangers, it is necessary to maintain the level of the refrigerant inside the heat source heat exchangers at a constant level or more. However, even if one tries to reduce the amount of refrigerant flowing through the heat source heat exchangers by reducing the openings of the heat source expansion valves when the heat source heating exchangers are caused to function as evaporators with little evaporating ability, such as when the air conditioning load in the plural utilization refrigerant circuits becomes extremely small, the evaporating ability cannot be sufficiently controlled just by regulating the openings of the heat source expansion valves because the openings of the heat source expansion valves cannot be reduced that much due to the restriction of the level of the refrigerant inside the heat source heat exchangers. As a result, it becomes necessary to conduct control to reduce the evaporating ability by closing some of the plural heat source expansion valves to reduce the number of heat source heat exchangers functioning as evaporators or to reduce the evaporating ability by causing some of the plural heat source heat exchangers to function as condensers to offset the evaporating ability of the heat source heat exchangers functioning as evaporators.

For this reason, there are the problems that increases in the number of parts and cost arise as a result of disposing plural heat source heat exchangers, the amount of the refrigerant compressed in the compressor increases in correspondence to the amount of refrigerant condensed by the heat source heat exchangers when some of the plural heat source heat exchangers are caused to function as condensers to reduce the evaporating ability, and the COP becomes poor in an operating condition where the overall air conditioning load of the plural utilization refrigerant circuits is small.

Further, in the aforementioned air conditioner, when a pressurizing circuit is disposed in the refrigerant circuit to cause the high-pressure gas refrigerant compressed by the compressor to merge with the refrigerant whose pressure has been reduced in the heat source expansion valve and which is sent to the utilization refrigerant circuits when the heat source heat exchangers are caused to function as condensers of the refrigerant, the refrigerant sent from the heat source expansion valve to the utilization refrigerant circuits becomes a gas-liquid two-phase flow. Moreover, the gas fraction of the refrigerant after the high-pressure gas refrigerant has merged therewith from the pressurizing circuit becomes larger the more the openings of the heat source expansion valves are reduced, and drift arises between the plural utilization refrigerant circuits, resulting in the problem that the openings of the heat source expansion valves cannot be sufficiently reduced. As a result, similar to when the heat source heat exchangers are caused to function as evaporators of the refrigerant, when plural heat source heat exchangers are disposed in the heat source refrigerant circuit and the overall air conditioning load of the plural utilization refrigerant circuits becomes extremely small, it becomes necessary to conduct control to reduce the condensing ability by closing the plural heat source expansion valves to reduce the number of heat source heat exchangers functioning as evaporators or to reduce the condensing ability by causing some of the plural heat source heat exchangers to function as evaporators to offset the condensing ability of the heat source heat exchangers functioning as condensers.

For this reason, there are the problems that increases in the number of parts and cost arise as a result of disposing plural heat source heat exchangers, the amount of the refrigerant compressed in the compressor increases in correspondence to the amount of refrigerant evaporated by the heat source heat exchangers when some of the plural heat source heat exchangers are caused to function as evaporators to reduce the condensing ability, and the COP becomes poor in an operating condition where the overall air conditioning load of the plural utilization refrigerant circuits is small.

It is an object of the present invention to expand, in an air conditioner disposed with a heat source refrigerant circuit and utilization refrigerant circuits connected to the heat source refrigerant circuit, the control width when the condensing ability of a heat source heat exchanger is controlled by a heat source expansion valve.

An air conditioner pertaining to a first aspect of the present invention comprises a heat source refrigerant circuit, one or more utilization refrigerant circuits, a pressurizing circuit, and a cooler. The heat source refrigerant circuit is configured by the interconnection of a compression mechanism, a heat source heat exchanger, and a heat source expansion valve that reduces the pressure of refrigerant condensed in the heat source heat exchanger when the heat source heat exchanger functions as a condenser. The utilization refrigerant circuits are connected to the heat source refrigerant circuit and configured by the interconnection of utilization heat exchangers and utilization expansion valves. The pressurizing circuit is disposed in the heat source refrigerant circuit and causes high-pressure gas refrigerant compressed in the compression mechanism to merge with refrigerant whose pressure is reduced in the heat source expansion valve and which is sent to the utilization refrigerant circuits. The cooler cools the refrigerant whose pressure is reduced in the heat source expansion valve and which is sent to the utilization refrigerant circuits.

In this air conditioner, when the pressure of the refrigerant condensed in the heat source heat exchanger functioning as a condenser is reduced by the heat source expansion valve and the refrigerant is sent to the utilization refrigerant circuits, the high-pressure gas refrigerant merges from the pressurizing circuit, the refrigerant sent to the utilization refrigerant circuits is pressurized, and the refrigerant pressure downstream of the heat source expansion valve rises. Here, when the high-pressure gas refrigerant is simply caused to merge as in conventional air conditioners, the refrigerant sent to the utilization refrigerant circuits ends up becoming a gas-liquid two-phase flow with a large gas fraction, and as a result, the opening of the heat source expansion valve cannot be sufficiently reduced. However, in this air conditioner, the refrigerant whose pressure is reduced by the heat source expansion valve and which is sent to the utilization refrigerant circuits is cooled by the cooler. For this reason, the gas refrigerant can be condensed, and refrigerant of a gas-liquid two-phase flow with a large gas fraction does not have to be sent to the utilization refrigerant circuits.

Thus, in this air conditioner, even if control is conducted to reduce the condensing ability of the heat source heat exchanger by reducing the opening of the heat source expansion valve in accordance with the air conditioning load of the utilization refrigerant circuits and control is conducted with the pressurizing circuit to merge the high-pressure gas refrigerant and pressurize the refrigerant sent to the utilization refrigerant circuits, refrigerant of a gas-liquid two-phase flow with a large gas fraction does not have to be sent to the utilization refrigerant circuits. For this reason, the control width when the evaporating ability of the heat source heat exchanger is controlled by the heat source expansion valve can be expanded.

Additionally, in this air conditioner, it becomes unnecessary to conduct control, as in conventional air conditioners disposed with plural heat source heat exchangers, to reduce the evaporating ability by closing some of plural heat source expansion valves to reduce the number of heat source heat exchangers functioning as evaporators when the heat source heat exchangers are caused to function as condensers or to reduce the evaporating ability by causing some of the heat source heat exchangers to function as condensers to offset the evaporating ability of the heat source heat exchangers functioning as evaporators. For this reason, a wide control width of the condensing ability can be obtained by a single heat source heat exchanger.

Thus, because simplification of the heat source heat exchanger becomes possible in an air conditioner where simplification of the heat source heat exchangers could not be realized by restricting the control width of the control of the condensing ability of the heat source heat exchangers, increases in the number of parts and cost that had occurred in conventional air conditioners as a result of disposing plural heat source heat exchangers can be prevented. Further, the problem of the COP becoming poor in an operating condition where, when some of plural heat source heat exchangers are caused to function as evaporators to reduce the condensing ability, the amount of refrigerant compressed in the compression mechanism increases in correspondence to the amount of refrigerant condensed by the heat source heat exchangers and the air conditioning load of the utilization refrigerant circuits is small can be eliminated.

An air conditioner pertaining to a second aspect of the present invention comprises the air conditioner pertaining to the first aspect of the present invention, wherein the pressurizing circuit is connected between the heat source expansion valve and the cooler such that the high-pressure gas refrigerant merges.

In this air conditioner, because the pressurizing circuit is connected between the heat source expansion valve and the cooler such that the high-pressure gas refrigerant merges, refrigerant whose temperature has risen as a result of the high-pressure gas refrigerant merging therewith becomes cooled by the cooler. Thus, it is not necessary to use a low-temperature cooling source as the cooling source for cooling the refrigerant in the cooler, and a cooling source with a relatively high temperature can be used.

An air conditioner pertaining to a third aspect of the present invention comprises the air conditioner pertaining to the first or second aspect of the present invention, further comprising a cooling circuit connected to the heat source refrigerant circuit such that some of the refrigerant sent from the heat source heat exchanger to the utilization refrigerant circuits branches from the heat source refrigerant circuit and is introduced to the cooler, and the cooler cools the refrigerant whose pressure is reduced in the heat source expansion valve and which is sent to the utilization refrigerant circuits and thereafter returns the cooled refrigerant to an intake side of the compression mechanism.

In this air conditioner, because refrigerant whose pressure has been reduced to a refrigerant pressure that can return, to the intake side of the compression mechanism, some of the refrigerant sent from the heat source heat exchanger to the utilization refrigerant circuits is used as the cooling source of the cooler, a cooling source with a sufficiently lower temperature than the temperature of the refrigerant whose pressure is reduced in the heat source expansion valve and which is sent to the utilization refrigerant circuits can be obtained. Thus, the refrigerant whose pressure is reduced in the heat source expansion valve and which is sent to the utilization refrigerant circuits can be cooled to a subcooled state.

An air conditioner pertaining to a fourth aspect of the present invention comprises the air conditioner pertaining to any of the first to third aspects of the present invention, wherein the heat source heat exchanger can function as an evaporator configured such that the refrigerant flows in from below and flows out from above. The air conditioner uses a combination of refrigerating machine oil and refrigerant that does not separate into two layers in a temperature range of 30° C. or below. The air conditioner further comprises an oil returning circuit that is connected to a lower portion of the heat source heat exchanger and returns the refrigerating machine oil accumulating inside the heat source heat exchanger to the compression mechanism together with the refrigerant.

In this air conditioner, the heat source heat exchanger is configured such that the refrigerant flows in from below and flows out from above when the heat source heat exchanger functions as an evaporator, and a combination of refrigerating machine oil and refrigerant that does not separate into two layers in a temperature range of 30° C. or below is used as the refrigerating machine oil and the refrigerant. Here, the evaporation temperature of the refrigerant in the heat source heat exchanger is a temperature of 30° C. or below when water and air are used as the heat sources. For this reason, in this air conditioner, the refrigerating machine oil does not accumulate in a state where it floats on the surface of the refrigerant inside the heat source heat exchanger, but rather accumulates inside the heat source heat exchanger in a state where it is mixed with the refrigerant. Additionally, the refrigerating machine oil accumulating inside the heat source heat exchanger is returned to the intake side of the compression mechanism together with the refrigerant by the oil returning circuit connected to the lower portion of the heat source heat exchanger. For this reason, it becomes unnecessary to maintain the level of the refrigerant inside the heat source heat exchanger at a constant level or more in order to prevent the refrigerating machine oil from accumulating inside the heat source heat exchanger as in conventional air conditioners.

Thus, in this air conditioner, even if control is conducted to reduce the evaporating ability of the heat source heat exchanger by reducing the opening of the heat source expansion valve in accordance with the air conditioning load of the utilization refrigerant circuits so that as a result the level of the refrigerant inside the heat source heat exchanger drops, the refrigerating machine oil does not accumulate inside the heat source heat exchanger. For this reason, the control width when the evaporating ability of the heat source heat exchanger is controlled by the heat source expansion valve can be expanded.

Additionally, in this air conditioner, it becomes unnecessary to conduct control, as in conventional air conditioners disposed with plural heat source heat exchangers, to reduce the evaporating ability by closing some of plural heat source expansion valves to reduce the number of heat source heat exchangers functioning as evaporators when the heat source heat exchangers are caused to function as evaporators or to reduce the evaporating ability by causing some of the heat source heat exchangers to function as condensers to offset the evaporating ability of the heat source heat exchangers functioning as evaporators. For this reason, a wide control width of the evaporating ability can be obtained by a single heat source heat exchanger.

Thus, because simplification of the heat source heat exchanger becomes possible in an air conditioner where simplification of the heat source heat exchangers could not be realized not just by restricting the control width of the control of the condensing ability of the heat source heat exchangers but also by restricting the control width of the control of the evaporating ability of the heat source heat exchangers, increases in the number of parts and cost that had occurred in conventional air conditioners as a result of disposing plural heat source heat exchangers can be prevented. Further, the problem of the COP becoming poor in an operating condition where the air conditioning load of the utilization refrigerant circuits is small can be eliminated.

A schematic diagram of a refrigerant circuit of an air conditioner of an embodiment pertaining to the invention.

FIG. 2

A diagram showing the overall schematic structure of a heat source heat exchanger.

FIG. 3

Figure 2:
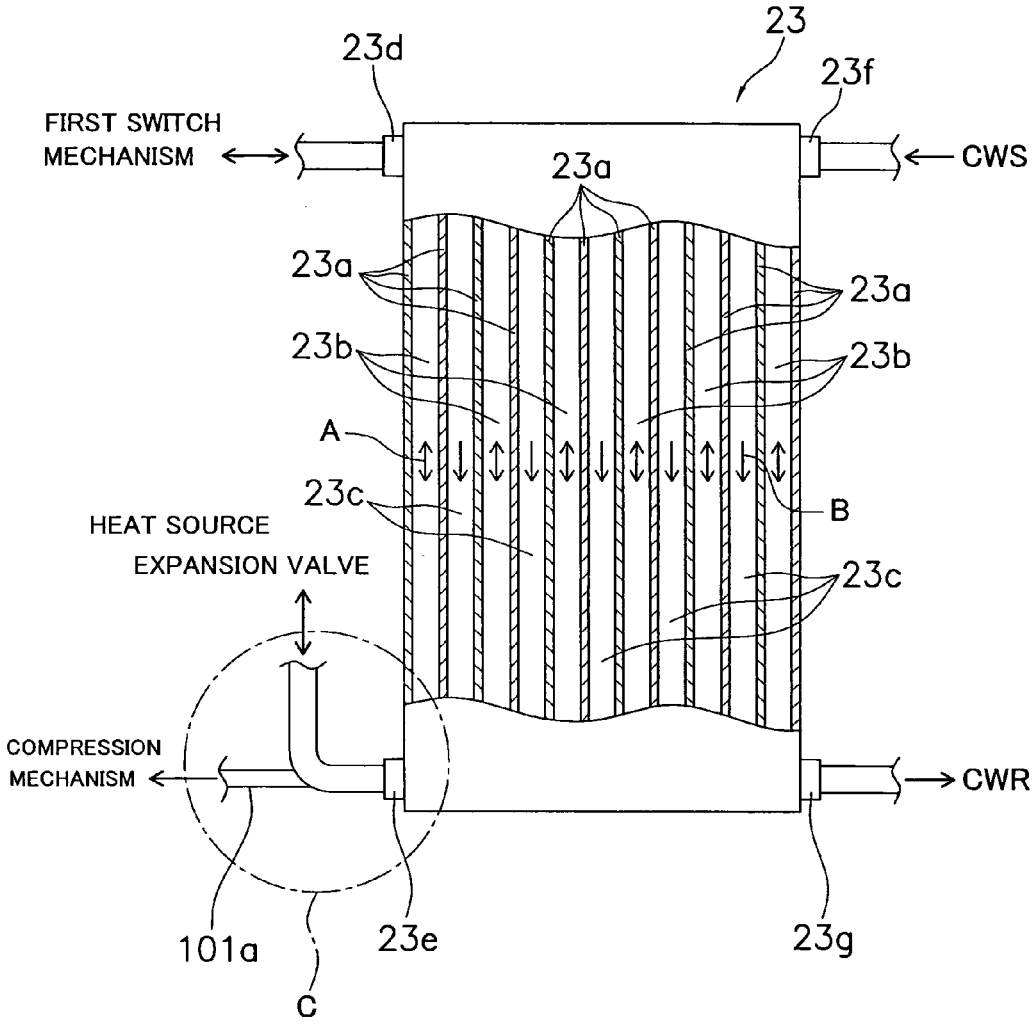

An enlarged view of portion C in FIG. 2 showing the schematic structure of a lower portion of the heat source heat exchanger.

FIG. 4

A schematic diagram of the refrigerant circuit describing the operation of the air conditioner during a heating operating mode.

FIG. 5

A schematic diagram of the refrigerant circuit describing the operation of the air conditioner during a cooling operating mode.

FIG. 6

A schematic diagram of the refrigerant circuit describing the operation of the air conditioner during a simultaneous cooling and heating operating mode (evaporation load).

FIG. 7

A schematic diagram of the refrigerant circuit describing the operation of the air conditioner during a simultaneous cooling and heating operating mode (condensation load).

FIG. 8

A schematic diagram of a refrigerant circuit of an air conditioner pertaining to modification 1.

FIG. 9

A schematic diagram of the refrigerant circuit describing the operation of the air conditioner of modification 1 during a heating operating mode.

FIG. 10

A schematic diagram of the refrigerant circuit describing the operation of the air conditioner of modification 1 during a cooling operating mode.

FIG. 11

A schematic diagram of a refrigerant circuit of an air conditioner pertaining to modification 2.

FIG. 12

A schematic diagram of a refrigerant circuit of an air conditioner pertaining to modification 3.

FIG. 13

A schematic diagram of a refrigerant circuit of an air conditioner pertaining to modification 4.

FIG. 14

A schematic diagram of the refrigerant circuit of the air conditioner pertaining to modification 4.

DETAILED DESCRIPTION OF THE INVENTION

An embodiment of an air conditioner pertaining to the invention will be described below on the basis of the drawings.

(1) Configuration of the Air Conditioner

Figure 1:
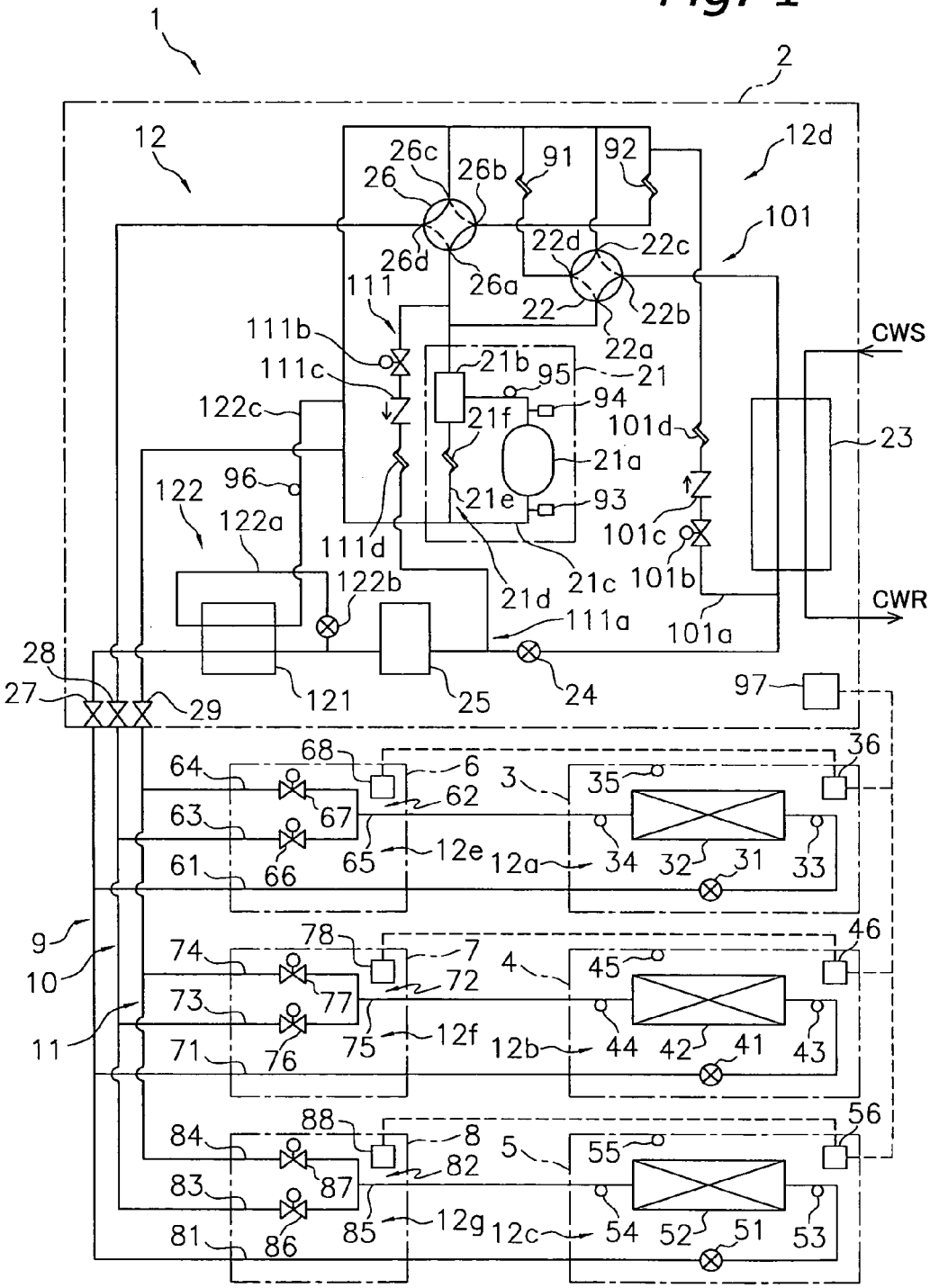
FIG. 1

FIG. 1 is a schematic diagram of a refrigerant circuit of an air conditioner 1 of an embodiment pertaining to the invention. The air conditioner 1 is an apparatus used to cool and heat the indoors of buildings and the like by conducting a vapor compression-type refrigerating cycle.

The air conditioner 1 is mainly disposed with one heat source unit 2; plural (three in the present embodiment) utilization units 3, 4 and 5; connection units 6, 7 and 8 connected to the utilization units 3, 4 and 5; and refrigerant communication pipes 9, 10 and 11 that connect the heat source unit 2 and the utilization units 3, 4 and 5 via the connection units 6, 7 and 8. The air conditioner 1 is configured such that it can conduct a simultaneous cooling and heating operation in accordance with the requirements of indoor air conditioned spaces where the utilization units 3, 4 and 5 are disposed, such as conducting a cooling operation in regard to a certain air conditioned space and conducting a heating operation in regard to another air conditioned space, for example. That is, a vapor compression-type refrigerant circuit 12 of the air conditioner 1 of the present embodiment is configured by the interconnection of the heat source unit 2, the utilization units 3, 4 and 5, the connection units 6, 7 and 8, and the refrigerant communication pipes 9, 10 and 11.

Additionally, in the present embodiment, a combination of refrigerating machine oil and refrigerant that does not separate into two layers in a temperature range of 30° C. or below is used in the refrigerant circuit 12 of the air conditioner 1. Examples of this combination of refrigerant and refrigerating machine oil include a combination of R410A and polyol ester (POE). Here, the reason a combination of refrigerating machine oil and refrigerant that does not separate into two layers in a temperature range of 30° C. or below is used is, given that the maximum evaporation temperature of the refrigerant when a heat source heat exchanger 23 (described later) of the heat source unit 2 is caused to function as an evaporator is 30° C., to ensure that the refrigerating machine oil and the refrigerant accumulating inside the heat source heat exchanger 23 does not separate into two layers in a temperature range equal to or less than this maximum evaporation temperature (i.e., 30° C.), so that the refrigerating machine oil can be extracted together with the refrigerant from the lower portion of the heat source heat exchanger 23 and returned to a compression mechanism 21 (described later) of the heat source unit 2.

<Utilization Units>

The utilization units 3, 4 and 5 are disposed such by being embedded in or hung from an indoor ceiling of a building or the like, or by being mounted on an indoor wall. The utilization units 3, 4 and 5 are connected to the heat source unit 2 via the refrigerant communication pipes 9, 10 and 11 and the connection units 6, 7 and 8, and configure part of the refrigerant circuit 12.

Next, the configuration of the utilization units 3, 4 and 5 will be described. It will be noted that because the utilization unit 3 has the same configuration as those of the utilization units 4 and 5, just the configuration of the utilization unit 3 will be described here, and in regard to the configurations of the utilization units 4 and 5, reference numerals in the 40s and 50s will be used instead of reference numerals in the 30s representing the respective portions of the utilization unit 3, and description of those respective portions will be omitted.

The utilization unit 3 mainly configures part of the refrigerant circuit 12 and is disposed with a utilization refrigerant circuit 12*a* (in the utilization units 4 and 5, utilization refrigerant circuits 12*b* and 12*c*). The utilization refrigerant circuit 12*a* is mainly disposed with a utilization expansion valve 31 and a utilization heat exchanger 32. In the present embodiment, the utilization expansion valve 31 is an electrically powered expansion valve connected to a liquid side of the utilization heat exchanger 32 in order to regulate the flow rate of the refrigerant flowing inside the utilization refrigerant circuit 12*a*. In the present embodiment, the utilization heat exchanger 32 is a cross fin-type fin-and-tube heat exchanger configured by a heat transfer tube and numerous fins, and is a device for conducting heat exchange between the refrigerant and the indoor air. In the present embodiment, the utilization unit 3 is disposed with a blower fan (not shown) for taking in indoor air to the inside of the unit, heat-exchanging the air, and thereafter supplying the air to the indoors as supply air, so that the indoor air and the refrigerant flowing through the utilization heat exchanger 32 can be heat-exchanged.

Various types of sensors are also disposed in the utilization unit 3. A liquid temperature sensor 33 that detects the temperature of liquid refrigerant is disposed at the liquid side of the utilization heat exchanger 32, and a gas temperature sensor 34 that detects the temperature of gas refrigerant is disposed at a gas side of the utilization heat exchanger 32. Moreover, an RA intake temperature sensor 35 that detects the temperature of the indoor air taken into the unit is disposed in the utilization unit 3. Further, the utilization unit 3 is disposed with a utilization control unit 36 that controls the operation of the respective portions configuring the utilization unit 3. Additionally, the utilization control unit 36 is disposed with a microcomputer and memory disposed in order to control the utilization unit 3, and is configured such that it can exchange control signals and the like with a remote controller (not shown) and exchange control signals and the like with the heat source unit 2.

<Heat Source Unit>

The heat source unit 2 is disposed on the roof or the like of a building or the like, is connected to the utilization units 3, 4 and 5 via the refrigerant communication pipes 9, 10 and 11, and configures the refrigerant circuit 12 between the utilization units 3, 4 and 5.

Next, the configuration of the heat source unit 2 will be described. The heat source unit 2 mainly configures part of the refrigerant circuit 12 and is disposed with a heat source refrigerant circuit 12*d*. The heat source refrigerant circuit 12*d* is mainly disposed with the compression mechanism 21, a first switch mechanism 22, the heat source heat exchanger 23, a heat source expansion valve 24, a receiver 25, a second switch mechanism 26, a liquid closing valve 27, a high-pressure gas closing valve 28, a low-pressure gas closing valve 29, a first oil returning circuit 101, a pressurizing circuit 111, a cooler 121, and a cooling circuit 122.

The compression mechanism 21 mainly includes a compressor 21*a*, an oil separator 21*b* connected to a discharge side of the compressor 21*a*, and a second oil returning circuit 21*d* that connects the oil separator 21*b* and an intake pipe 21*c* of the compressor 21*a*. In the present embodiment, the compressor 21*a* is a positive-displacement compressor whose running capacity can be varied by inverter control. The oil separator 21*b* is a container that separates the refrigerating machine oil accompanying the high-pressure gas refrigerant compressed and discharged in the compressor 21*a*. The second oil returning circuit 21*d* is a circuit for returning the refrigerating machine oil separated in the oil separator 21*b* to the compressor 21*a*. The second oil returning circuit 21*d* mainly includes an oil returning pipe 21*e*, which connects the oil separator 21*b* and the intake pipe 21*c* of the compressor 21*a*, and a capillary tube 21*f*, which reduces the pressure of the high-pressure refrigerating machine oil separated in the oil separator 21*b* connected to the oil returning pipe 21*e*. The capillary tube 21*f* is a narrow tube that reduces, to the refrigerant pressure of the intake side of the compressor 21*a*, the pressure of the high-pressure refrigerating machine oil separated in the oil separator 21*b*. In the present embodiment, the compression mechanism 21 only has the one compressor 21*a* but is not limited thereto, and may also be one where two or more compressors are connected in parallel in accordance with the connection number of utilization units.

The first switch mechanism 22 is a four-way switch valve that can switch between flow paths of the refrigerant inside the heat source refrigerant circuit 12*d* such that when the heat source heat exchanger 23 is caused to function as a condenser (below, referred to as a condensation operating state), the first switch mechanism 22 connects the discharge side of the compression mechanism 21 and the gas side of the heat source heat exchanger 23, and when the heat source heat exchanger 23 is caused to function as an evaporator (below, referred to as an evaporation operating state), the first switch mechanism 22 connects the intake side of the compression mechanism 21 and the gas side of the heat source heat exchanger 23. A first port 22*a* of the first switch mechanism 22 is connected to the discharge side of the compression mechanism 21, a second port 22*b* of the first switch mechanism 22 is connected to the gas side of the heat source heat exchanger 23, a third port 22*c* of the first switch mechanism 22 is connected to the intake side of the compression mechanism 21, and a fourth port 22*d* of the first switch mechanism 22 is connected to the intake side of the compression mechanism 21 via a capillary tube 91. Additionally, as mentioned previously, the first switch mechanism 22 can conduct switching that connects the first port 22*a* and the second port 22*b* and connects the third port 22*c* and the fourth port 22*d* (corresponding to the condensation operating state; refer to the solid lines of the first switch mechanism 22 in FIG. 1), and connects the second port 22*b* and the third port 22*c* and connects the first port 22*a* and the fourth port 22*d* (corresponding to the evaporation operating state; refer to the dotted lines of the first switch mechanism 22 in FIG. 1).

The heat source heat exchanger 23 is a heat exchanger that can function as an evaporator of the refrigerant and as a condenser of the refrigerant. In the present embodiment, the heat source heat exchanger 23 is a plate heat exchanger that exchanges heat with the refrigerant using water as the heat source. The gas side of the heat source heat exchanger 23 is connected to the second port 22*b* of the first switch mechanism 22, and the liquid side of the heat source heat exchanger 22 is connected to the heat source expansion valve 24. As shown in FIG. 2, the heat source heat exchanger 23 is configured such that it can conduct heat exchange as a result of plural plate members 23*a* formed by pressing or the like being superposed via packing (not shown) so that plural flow paths 23*b* and 23*c* extending in the vertical direction are formed between the plate members 23*a*, whereby the refrigerant and water alternately flow inside these plural flow paths 23*b* and 23*c* (specifically, the refrigerant flows inside the flow paths 23*b* and the water flows inside the flow paths 23*c*; refer to arrows A and B in FIG. 2). Additionally, the plural flow paths 23*b* are mutually communicated at their upper end portions and lower end portions, and are connected to a gas nozzle 23*d* and a liquid nozzle 23*e* disposed on the upper portion and the lower portion of the heat source heat exchanger 23. The gas nozzle 23*d* is connected to the first switch mechanism 22, and the liquid nozzle 23*e* is connected to the heat source expansion valve 24. Thus, as shown by arrow A in FIG. 2, when the heat source heat exchanger 23 functions as an evaporator, the refrigerant flows in from the liquid nozzle 23*e* (i.e., from below) and flows out from the gas nozzle 23*d* (i.e., from above), and when the heat source heat exchanger 23 functions as a condenser, the refrigerant flows in from the gas nozzle 23*d* (i.e., from above) and flows out from the liquid nozzle 23*e* (i.e., from below). Further, the plural flow paths 23*c* are mutually communicated at their upper end portions and lower end portions, and are connected to a water inlet nozzle 23*f* and a water outlet nozzle 23*g* disposed on the upper portion and the lower portion of the heat source heat exchanger 23. Further, in the present embodiment, the water serving as the heat source flows in as supply water CWS from the water inlet nozzle 23*f* of the heat source heat exchanger 23 through a water pipe (not shown) from a cooling tower facility or a boiler facility disposed outside the air conditioner 1, is heat-exchanged with the refrigerant, flows out from the water outlet nozzle 23*g*, and is returned as discharge water CWR to the cooling tower facility or the boiler facility. Here, a constant amount of the water supplied from the cooling tower facility or the boiler facility is supplied without relation to the flow rate of the refrigerant flowing inside the heat source heat exchanger 23.

In the present embodiment, the heat source expansion valve 24 is an electrically powered expansion valve that can regulate the flow rate of the refrigerant flowing between the heat source heat exchanger 23 and the utilization refrigerant circuits 12*a*, 12*b* and 12*c* via the liquid refrigerant communication pipe 9, and is connected to the liquid side of the heat source heat exchanger 23.

The receiver 25 is a container for temporarily accumulating the refrigerant flowing between the heat source heat exchanger 23 and the utilization refrigerant circuits 12*a*, 12*b* and 12*c*. In the present embodiment, the receiver 25 is connected between the heat source expansion valve 24 and the cooler 121.

The second switch mechanism 26 is a four-way switch valve that can switch between the flow paths of the refrigerant inside the heat source refrigerant circuit 12*d* such that when the heat source unit 2 is used as a heat source unit for a simultaneous cooling and heating machine (refer to FIGS. 4 to 7) and sends the high-pressure gas refrigerant to the utilization refrigerant circuits 12*a*, 12*b* and 12*c* (below, referred to as a heating load requirement operating state), the second switch mechanism 26 connects the discharge side of the compression mechanism 21 and the high-pressure gas closing valve 28, and when the heat source unit 2 is used as a heat source unit for a cooling and heating switching machine (modification 1; refer to FIGS. 8 to 10; below, referred to as a cooling/heating switching time cooling operating state) to conduct a cooling operation, the second switch mechanism 26 connects the high-pressure gas closing valve 28 and the intake side of the compression mechanism 21. A first port 26*a* of the second switch mechanism 26 is connected to the discharge side of the compression mechanism 21, a second port 26*b* of the second switch mechanism 26 is connected to the intake side of the compression mechanism 21 via a capillary tube 92, a third port 26*c* of the second switch mechanism 26 is connected to the intake side of the compression mechanism 21, and a fourth port 26*d* of the second switch mechanism 26 is connected to the high-pressure gas closing valve 28. Additionally, as mentioned previously, the second switch mechanism 26 can conduct switching that connects the first port 26*a* and the second port 26*b* and connects the third port 26*c* and the fourth port 26*d* (corresponding to the cooling/heating switching time cooling operating state; refer to the solid lines of the second switch mechanism 26 in FIG. 1), and connects the second port 26*b* and the third port 26*c* and connects the first port 26*a* and the fourth port 26*d* (corresponding to the heating load requirement operating state; refer to the dotted lines of the second switch mechanism 26 in FIG. 1).

The liquid closing valve 27, the high-pressure gas closing valve 28 and the low-pressure gas closing valve 29 are valves disposed at ports connected to external devices/pipes (specifically, the refrigerant communication pipes 9, 10 and 11). The liquid closing valve 27 is connected to the cooler 121. The high-pressure gas closing valve 28 is connected to the fourth port 26*d* of the second switch mechanism 26. The low-pressure gas closing valve 29 is connected to the intake side of the compression mechanism 21.

Figure 3:
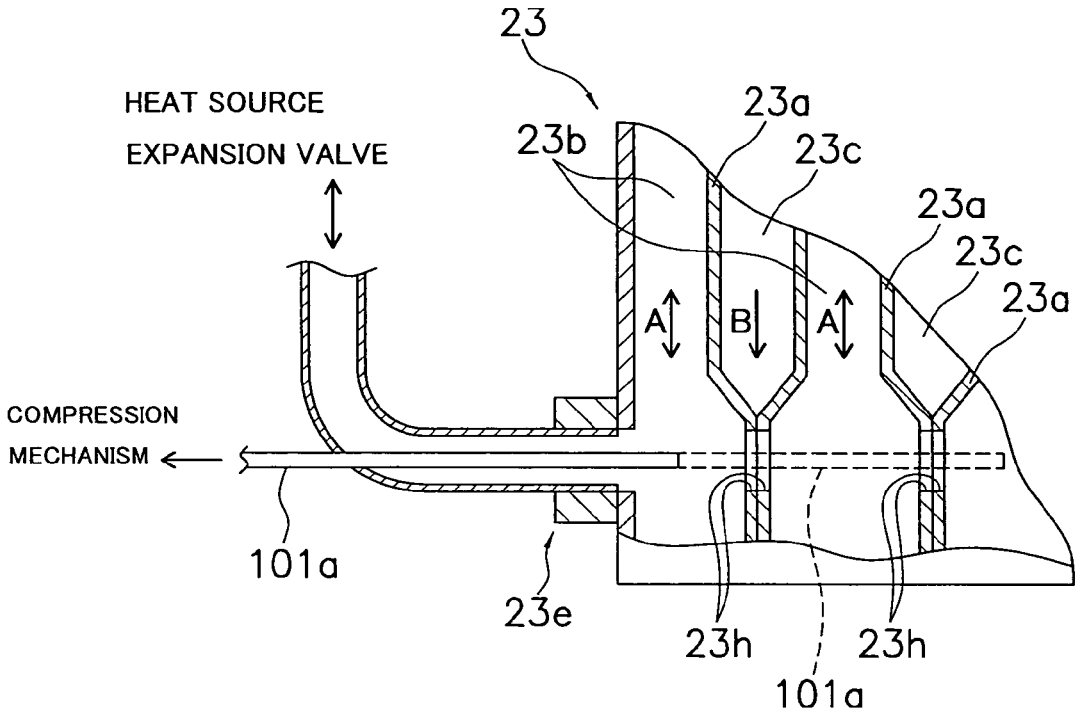

The first oil returning circuit 101 is a circuit that returns the refrigerating machine oil accumulating inside the heat source heat exchanger 23 to the compression mechanism 21 together with the refrigerant during the evaporation operating state, i.e., when the heat source heat exchanger 23 is caused to function as an evaporator. The first oil returning circuit 101 mainly includes an oil returning pipe 101*a* that connects the lower portion of the heat source heat exchanger 23 and the compression mechanism 21, a control valve 101*b* connected to the oil returning pipe 101*a*, a check valve 101*c*, and a capillary tube 101*d*. The oil returning pipe 101*a* is disposed such that one end can extract the refrigerating machine oil together with the refrigerant from the lower portion of the heat source heat exchanger 23. In the present embodiment, as shown in FIG. 3, the oil returning pipe 101*a* is a pipe extending inside the flow paths 23*b* through which flows the refrigerant of the heat source heat exchanger 23 through the inside of the pipe of the liquid nozzle 23*e* disposed in the lower portion of the heat source heat exchanger 23. Here, communication holes 23*h* are disposed in the plate members 23*a* in the heat source heat exchanger 23 in order to allow the plural flow paths 23*b* to be communicated with each other (the same is true of the plural flow paths 23*c*). For this reason, the oil returning pipe 101*a* may also be disposed such that it penetrates the plural flow paths 23*b* (refer to the oil returning pipe 101*a* indicated by the dotted lines in FIG. 3). Further, in the present embodiment, the other end of the oil returning pipe 101*a* is connected to the intake side of the compression mechanism 21. In the present embodiment, the control valve 101*b* is an electromagnetic valve that is connected to ensure that it can use the first oil returning circuit 101 as needed, and can circulate and cut off the refrigerant and the refrigerating machine oil. The check valve 101*c* is a valve that allows the refrigerant and the refrigerating machine oil to flow just inside the oil returning pipe 101*a* toward the intake side of the compression mechanism 21 from the lower portion of the heat source heat exchanger 23. The capillary tube 101*d* is a narrow tube that reduces, to the refrigerant pressure of the intake side of the compression mechanism 21, the pressure of the refrigerant and the refrigerating machine oil extracted from the lower portion of the heat source heat exchanger 23.

The pressurizing circuit 111 is a circuit that causes the high-pressure gas refrigerant compressed in the compression mechanism 21 to merge with the refrigerant that is condensed in the heat source heat exchanger 23, pressure-reduced in the heat source expansion valve 24, and sent to the utilization refrigerant circuits 12*a*, 12*b* and 12*c* during the condensation operating state, i.e., when the heat source heat exchanger 23 is caused to function as a condenser. The pressurizing circuit 111 mainly includes a pressurizing pipe 111*a* that connects the discharge side of the compression mechanism 21 and the downstream side of the heat source expansion valve 24 (i.e., between the heat source expansion valve 24 and the liquid closing valve 27), a control valve 111*b* connected to the pressurizing pipe 111*a*, a check valve 111*c*, and a capillary tube 111*d*. In the present embodiment, one end of the pressurizing pipe 111*a* is connected between the outlet of the oil separator 21*b* of the compression mechanism 21 and the first ports 22*a* and 26*a* of the first and second switch mechanisms 22 and 26. Further, in the present embodiment, the other end of the pressurizing pipe 111*a* is connected between the heat source expansion valve 24 and the receiver 25. In the present embodiment, the control valve 111*b* is an electromagnetic valve that is connected to ensure that it can use the pressurizing circuit 111 as needed, and can circulate and cut off the refrigerant. The check valve 111*c* is a valve that allows the refrigerant to flow just inside the pressurizing pipe 111*a* toward the downstream side of the heat source expansion valve 24 from the discharge side of the compression mechanism 21. The capillary tube 111*d* is a narrow tube that reduces, to the refrigerant pressure of the downstream side of the heat source expansion valve 24, the pressure of the refrigerant extracted from the discharge side of the compression mechanism 21.

The cooler 121 is a heat exchanger that cools the refrigerant that is condensed in the heat source heat exchanger 23, pressure-reduced in the heat source expansion valve 24, and sent to the utilization refrigerant circuits 12*a*, 12*b* and 12*c* during the condensation operating state, i.e., when the heat source heat exchanger 23 is caused to function as a condenser. In the present embodiment, the cooler 121 is connected between the receiver 25 and the liquid closing valve 27. In other words, the pressurizing circuit 111 is connected such that the pressurizing pipe 111*a* is connected between the heat source expansion valve 24 and the cooler 121, so that the high-pressure gas refrigerant merges with the refrigerant whose pressure has been reduced in the heat source expansion valve 24. A double tube heat exchanger, for example, can be used as the cooler 121.

The cooling circuit 122 is a circuit connected to the heat source refrigerant circuit 12*d* such that during the condensation operating state, i.e., when the heat source heat exchanger 23 is caused to function as a condenser, the cooling circuit 122 causes some of the refrigerant sent from the heat source heat exchanger 23 to the utilization refrigerant circuits 12*a*, 12*b* and 12*c* to branch from the heat source refrigerant circuit 12*d* and be introduced to the cooler 121, cools the refrigerant that is condensed in the heat source heat exchanger 23, pressure-reduced in the heat source expansion valve 24, and sent to the utilization refrigerant circuits 12*a*, 12*b* and 12*c*, and returns the refrigerant to the intake side of the compression mechanism 21. The cooling circuit 122 mainly includes a lead-in pipe 122*a* that introduces to the cooler 121 some of the refrigerant sent from the heat source heat exchanger 23 to the utilization refrigerant circuits 12*a*, 12*b* and 12*c*, a cooling circuit expansion valve 122*b* connected to the lead-in pipe 122*a*, and a lead-out pipe 122*c* that returns, to the intake side of the compression mechanism 21, the refrigerant passing through the cooler 121. In the present embodiment, one end of the lead-in pipe 122*a* is connected between the receiver 25 and the cooler 121. Further, in the present embodiment, the other end of the lead-in pipe 122*a* is connected to the inlet of the cooling circuit 122 side of the cooler 121. In the present embodiment, the cooling circuit expansion valve 122*b* is an electrically powered expansion valve that is connected to ensure that it can use the cooling circuit 122 as needed, and can regulate the flow rate of the refrigerant flowing through the cooling circuit 122. In the present embodiment, one end of the lead-out pipe 122*c* is connected to the outlet of the cooling circuit 122 side of the cooler 121. Further, in the present embodiment, the other end of the lead-out pipe 122*c* is connected to the intake side of the compression mechanism 21.

Further, various types of sensors are disposed in the heat source unit 2. Specifically, the heat source unit 2 is disposed with an intake pressure sensor 93 that detects the intake pressure of the compression mechanism 21, a discharge pressure sensor 94 that detects the discharge pressure of the compression mechanism 21, a discharge temperature sensor 95 that detects the discharge temperature of the refrigerant of the discharge side of the compression mechanism 21, and a cooling circuit outlet temperature sensor 96 that detects the temperature of the refrigerant flowing through the lead-out pipe 122*c* of the cooling circuit 122. Further, the heat source unit 2 is disposed with a heat source control unit 97 that controls the operation of the respective portions configuring the heat source unit 2. Additionally, the heat source control unit 97 includes a microcomputer and a memory disposed in order to control the heat source unit 2, and is configured such that it can exchange control signals and the like with the utilization control units 36, 46 and 56 of the utilization units 3, 4 and 5.

<Connection Units>

The connection units 6, 7 and 8 are disposed together with the utilization units 3, 4 and 5 inside the room of a building or the like. The connection units 6, 7 and 8 are intervened between the utilization units 3, 4 and 5 and the heat source unit 2 together with the refrigerant communication pipes 9, 10 and 11, and configure part of the refrigerant circuit 12.

Next, the configuration of the connection units 6, 7 and 8 will be described. It will be noted that because the connection unit 6 has the same configuration as those of the connection units 7 and 8, just the configuration of the connection unit 6 will be described here, and in regard to the configurations of the connection units 7 and 8, reference numerals in the 70s and 80s will be used instead of reference numerals in the 60s representing the respective portions of the connection unit 6, and description of those respective portions will be omitted.

The connection unit 6 mainly configures part of the refrigerant circuit 12 and is disposed with a connection refrigerant circuit 12*e* (in the connection units 7 and 8, connection refrigerant circuits 12*f* and 12*g*, respectively). The connection refrigerant circuit 12*e* mainly includes a liquid connection pipe 61, a gas connection pipe 62, a high-pressure gas control valve 66, and a low-pressure gas control valve 67. In the present embodiment, the liquid connection pipe 61 connects the liquid refrigerant communication pipe 9 and the utilization expansion valve 31 of the utilization refrigerant circuit 12*a*. The gas connection pipe 62 includes a high-pressure gas connection pipe 63 connected to the high-pressure gas refrigerant communication pipe 10, a low-pressure gas connection pipe 64 connected to the low-pressure gas refrigerant communication pipe 11, and a junction gas connection pipe 65 that merges the high-pressure gas connection pipe 63 and the low-pressure gas connection pipe 64. The junction gas connection pipe 65 is connected to the gas side of the utilization heat exchanger 32 of the utilization refrigerant circuit 12*a*. Additionally, in the present embodiment, the high-pressure gas control valve 66 is an electromagnetic valve that is connected to the high-pressure gas connection pipe 63 and can circulate and cut off the refrigerant. In the present embodiment, the low-pressure gas control valve 67 is an electromagnetic valve that is connected to the low-pressure gas connection pipe 64 and can circulate and cut off the refrigerant. Thus, when the utilization unit 3 conducts the cooling operation, the connection unit 6 can function to close the high-pressure gas control valve 66 and open the low-pressure gas control valve 67 such that the refrigerant flowing into the liquid connection pipe 61 through the liquid refrigerant communication pipe 9 is sent to the utilization expansion valve 31 of the utilization refrigerant circuit 12*a*, pressure-reduced by the utilization expansion valve 31, evaporated in the utilization heat exchanger 32, and thereafter returned to the low-pressure gas refrigerant communication pipe 11 through the junction gas connection pipe 65 and the low-pressure gas connection pipe 64. Further, when the utilization unit 3 conducts the heating operation, the connection unit 6 can function to close the low-pressure gas control valve 67 and open the high-pressure gas control valve 66 such that the refrigerant flowing into the high-pressure gas connection pipe 63 and the junction gas connection pipe 65 through the high-pressure gas refrigerant communication pipe 10 is sent to the gas side of the utilization heat exchanger 32 of the utilization refrigerant circuit 12*a*, condensed in the utilization heat exchanger 32, pressure-reduced by the utilization expansion valve 31, and thereafter returned to the liquid refrigerant communication pipe 9 through the liquid connection pipe 61. Further, the connection unit 6 is disposed with a connection control unit 68 that controls the operation of the respective portions configuring the connection unit 6. Additionally, the connection control unit 68 includes a microcomputer and a memory disposed in order to control the connection unit 6, and is configured such that it can exchange control signals and the like with the utilization control unit 36 of the utilization unit 3.

As described above, the refrigerant circuit 12 of the air conditioner 1 is configured by the interconnection of the utilization refrigerant circuits 12*a*, 12*b* and 12*c*, the heat source refrigerant circuit 12*d*, the refrigerant communication pipes 9, 10 and 11, and the connection refrigerant circuits 12*e*, 12*f* and 12*g*. Additionally, the air conditioner 1 of the present embodiment can conduct a simultaneous cooling and heating operation, such as the utilization unit 5 conducting a heating operation while the utilization units 3 and 4 conduct a cooling operation, for example.

Additionally, in the air conditioner 1 of the present embodiment, as will be described later, the control width when the evaporating ability of the heat source heat exchanger 23 is controlled by the heat source expansion valve 24 is expanded by using the first oil returning circuit 101 when the heat source heat exchanger 23 is caused to function as an evaporator, so that a wide control width of the evaporating ability can be obtained by the single heat source heat exchanger 23.

Further, in the air conditioner 1, as will be described later, the control width when the condensing ability of the heat source heat exchanger 23 is controlled by the heat source expansion valve 24 is expanded by using the pressurizing circuit 111 and the cooler 121 when the heat source heat exchanger 23 is caused to function as a condenser, so that a wide control width of the condensing ability can be obtained by the single heat source heat exchanger 23. Thus, in the air conditioner 1 of the present embodiment, simplification of the heat source heat exchanger, which had been plurally disposed in conventional air conditioners, is realized.

(2) Operation of the Air Conditioner

Next, the operation of the air conditioner 1 of the present embodiment will be described.

The operating modes of the air conditioner 1 of the present embodiment can be divided in accordance with the air conditioning load of each of the utilization units 3, 4 and 5 into a heating operating mode where all of the utilization units 3, 4 and 5 conduct the heating operation, a cooling operating mode where all of the utilization units 3, 4 and 5 conduct the cooling operation, and a simultaneous cooling and heating operating mode where some of the utilization units 3, 4 and 5 conduct the cooling operation while the other utilization units conduct the heating operation. Further, in regard to the simultaneous cooling and heating operating mode, the operating mode can be divided by the overall air conditioning load of the utilization units 3, 4 and 5 into when the heat source heat exchanger 23 of the heat source unit 2 is caused to function and operate as an evaporator (evaporation operating state) and when the heat source heat exchanger 23 of the heat source unit 2 is caused to function and operate as a condenser (condensation operating state).

The operation of the air conditioner 1 in the four operating modes will be described below.

<Heating Operating Mode>

Figure 4:
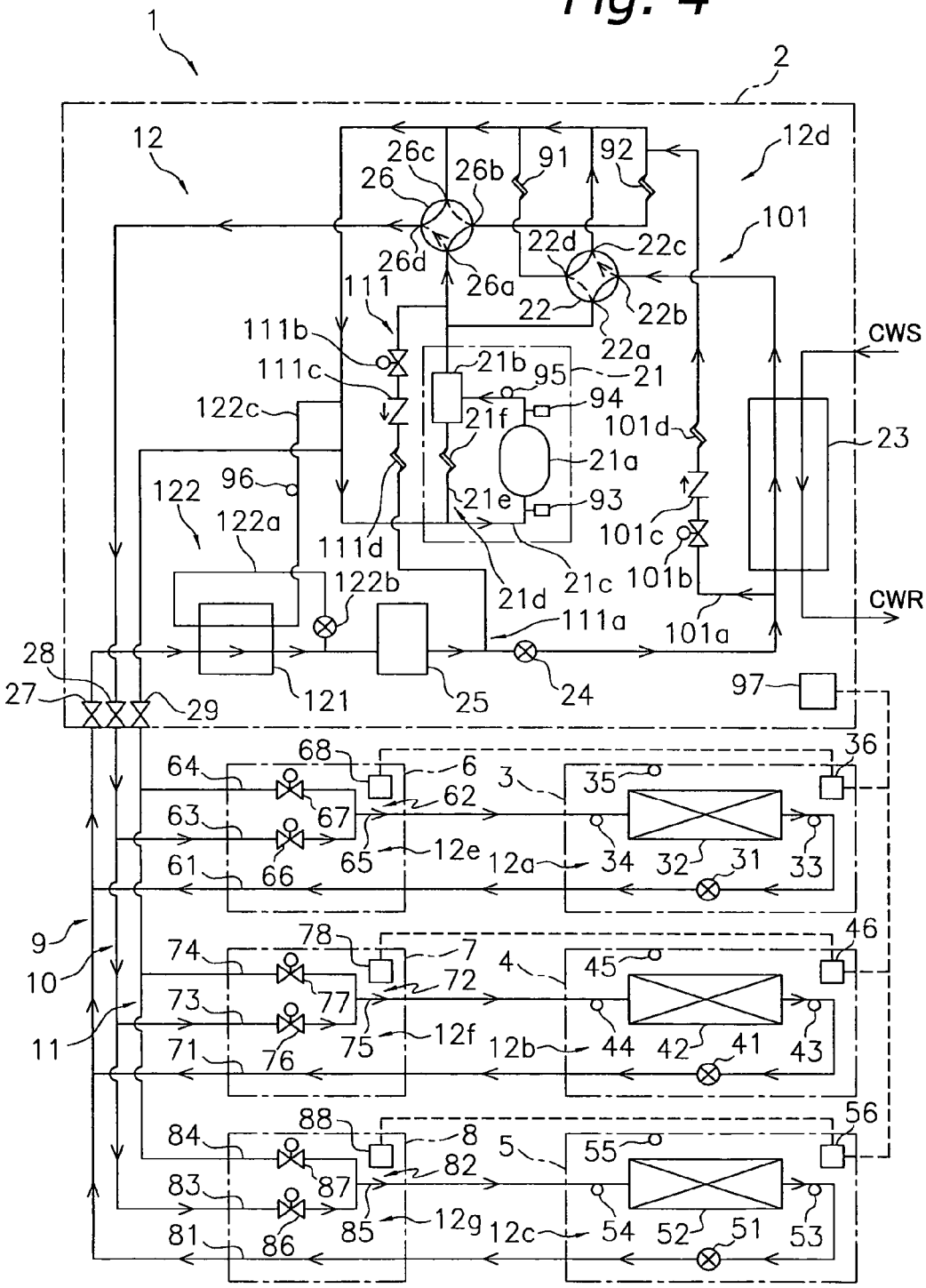

When all of the utilization units 3, 4 and 5 conduct the heating operation, the refrigerant circuit 12 of the air conditioner 1 is configured as shown in FIG. 4 (refer to the arrows added to the refrigerant circuit 12 in FIG. 4 for the flow of the refrigerant). Specifically, in the heat source refrigerant circuit 12*d* of the heat source unit 2, the first switch mechanism 22 is switched to the evaporation operating state (the state indicated by the dotted lines of the first switch mechanism 22 in FIG. 4) and the second switch mechanism 26 is switched to the heating load requirement operating state (the state indicated by the dotted lines of the second switch mechanism 26 in FIG. 4), whereby the heat source heat exchanger 23 is caused to function as an evaporator such that the high-pressure gas refrigerant compressed and discharged in the compression mechanism 21 can be supplied to the utilization units 3, 4 and 5 through the high-pressure gas refrigerant communication pipe 10. Further, the opening of the heat source expansion valve 24 is regulated to reduce the pressure of the refrigerant. It will be noted that the control valve 111*b* of the pressurizing circuit 111 and the cooling circuit expansion valve 122*b* of the cooling circuit 122 are closed so that the high-pressure gas refrigerant is caused to merge with the refrigerant flowing through the heat source expansion valve 24 and the receiver 25, the supply of the cooling source to the cooler 121 is shut off, and the refrigerant flowing between the receiver 25 and the utilization units 3, 4 and 5 is not cooled. In the connection units 6, 7 and 8, the low-pressure gas control valves 67, 77 and 87 are closed and the high-pressure gas control valves 66, 76 and 86 are opened, whereby the utilization heat exchangers 32, 42 and 52 of the utilization units 3, 4 and 5 are caused to function as condensers. In the utilization units 3, 4 and 5, the openings of the utilization expansion valves 31, 41 and 51 are regulated in accordance with the heating load of each utilization unit, such as the openings being regulated on the basis of the degree of subcooling of the utilization heat exchangers 32, 42 and 52 (specifically, the temperature difference between the refrigerant temperature detected by the liquid temperature sensors 33, 43 and 53 and the refrigerant temperature detected by the gas temperature sensors 34, 44 and 54), for example.

In this configuration of the refrigerant circuit 12, a large portion of the refrigerating machine oil accompanying the high-pressure gas refrigerant that has been compressed and discharged by the compressor 21*a* of the compression mechanism 21 is separated in the oil separator 21*b*, and the high-pressure gas refrigerant is sent to the second switch mechanism 26. Then, the refrigerating machine oil separated in the oil separator 21*b* is returned to the intake side of the compressor 21*a* through the second oil returning circuit 21*d*. The high-pressure gas refrigerant sent to the second switch mechanism 26 is sent to the high-pressure gas refrigerant communication pipe 10 through the first port 26*a* and the fourth port 26*d* of the second switch mechanism 26 and the high-pressure gas closing valve 28.

Then, the high-pressure gas refrigerant sent to the high-pressure gas refrigerant communication pipe 10 is branched into three and sent to the high-pressure gas connection pipes 63, 73 and 83 of the connection units 6, 7 and 8. The high-pressure gas refrigerant sent to the high-pressure gas connection pipes 63, 73 and 83 of the connection units 6, 7 and 8 is sent to the utilization heat exchangers 32, 42 and 52 of the utilization units 3, 4 and 5 through the high-pressure gas control valves 66, 76 and 86.

Then, the high-pressure gas refrigerant sent to the utilization heat exchangers 32, 42 and 52 is condensed in the utilization heat exchangers 32, 42 and 52 of the utilization units 3, 4 and 5 as a result of heat exchange being conducted with the indoor air. The indoor air is heated and supplied to the indoors. The refrigerant condensed in the utilization heat exchangers 32, 42 and 52 passes through the utilization expansion valves 31, 41 and 51 and is thereafter sent to the liquid connection pipes 61, 71 and 81 of the connection units 6, 7 and 8.

Then, the refrigerant sent to the liquid connection pipes 61, 71 and 81 is sent to the liquid refrigerant communication pipe 9 and merges.

Then, the refrigerant that has been sent to the liquid refrigerant communication pipe 9 and merged is sent to the receiver 25 through the liquid closing valve 27 and the cooler 121 of the heat source unit 2. The refrigerant sent to the receiver 25 is temporarily accumulated inside the receiver 25, and the pressure of the refrigerant is thereafter reduced by the heat source expansion valve 24. Then, the refrigerant whose pressure has been reduced by the heat source expansion valve 24 is evaporated in the heat source heat exchanger 23 as a result of heat exchange being conducted with water serving as a heat source, becomes low-pressure gas refrigerant, and is sent to the first switch mechanism 22. Then, the low-pressure gas refrigerant sent to the first switch mechanism 22 is returned to the intake side of the compression mechanism 21 through the second port 22*b* and the third port 22*c* of the first switch mechanism 22. In this manner, the operation in the heating operating mode is conducted.

At this time, there are cases where the heating loads of the utilization units 3, 4 and 5 become extremely small. In such cases, it is necessary to reduce the refrigerant evaporating ability in the heat source heat exchanger 23 of the heat source unit 2 and balance the overall heating load of the utilization units 3, 4 and 5 (specifically, the condensation loads of the utilization heat exchangers 32, 42 and 52). For this reason, control is conducted to reduce the evaporation amount of the refrigerant in the heat source heat exchanger 23 by conducting control to reduce the opening of the heat source expansion valve 24. When control is conducted to reduce the opening of the heat source expansion valve 24, the level of the refrigerant inside the heat source heat exchanger 23 drops. Thus, in a heat exchanger configured such that the refrigerant flows in from below and flows out from above when the heat exchanger functions as an evaporator of the refrigerant (see FIG. 2 and FIG. 3), like the heat source heat exchanger 23 of the present embodiment, it becomes difficult for the refrigerating machine oil to be discharged together with the evaporated refrigerant, and it becomes easy for accumulation of the refrigerating machine oil to occur.

However, in the air conditioner 1 of the present embodiment, a combination of refrigerating machine oil and refrigerant that does not separate into two layers in a temperature range of 30° C. or below is used, and the first oil returning circuit 101 is disposed. Additionally, the control valve 101*b* of the first oil returning circuit 101 is configured to be opened during the heating operating mode (i.e., when the first switch mechanism 22 is in the evaporation operating state) such that it can extract, and return to the compression mechanism 21, the refrigerating machine oil together with the refrigerant from the inside of the heat source heat exchanger 23 from the lower portion of the heat source heat exchanger 23 through the oil returning pipe 101*a*. For this reason, even though the level of the refrigerant inside the heat source heat exchanger 23 drops as a result of control being conducted to reduce the opening of the heat source expansion valve 24 and it becomes difficult for the refrigerating machine oil to be discharged together with the evaporated refrigerant, accumulation of the refrigerating machine oil inside the heat source heat exchanger 23 can be prevented.

It will be noted that it is preferable for the control valve 101*b* to be closed when the first switch mechanism 22 is in the condensation operating state and to be opened when the first switch mechanism 22 is in the evaporation operating state because when the control valve 101*b* is opened when the heat source heat exchanger 23 functions as a condenser, some of the refrigerant condensed in the heat source heat exchanger 23 is returned to the compression mechanism 21 and the amount of refrigerant sent to the utilization refrigerant circuits 12*a*, 12*b* and 12*c* is reduced. Moreover, the control valve 101*b* may also be configured such that when the first switch mechanism 22 is in the evaporation operating state, the control valve 101*b* is opened only when the level of the refrigerant inside the heat source heat exchanger 23 drops as a result of control being conducted to reduce the opening of the heat source expansion valve 24 and it becomes difficult for the refrigerating machine oil to be discharged together with the evaporated refrigerant. For example, the conditions under which the control valve 101*b* is opened may be when the first switch mechanism 22 is in the evaporation operating state and when the heat source expansion valve 24 is equal to or less than a predetermined opening. The opening of the heat source expansion valve 24 when the level of the refrigerant inside the heat source heat exchanger 23 drops and it becomes difficult for the refrigerating machine oil to be discharged together with the evaporated refrigerant is found experimentally, and the predetermined opening is determined on the basis of the experimentally found opening.

<Cooling Operating Mode>

Figure 5:
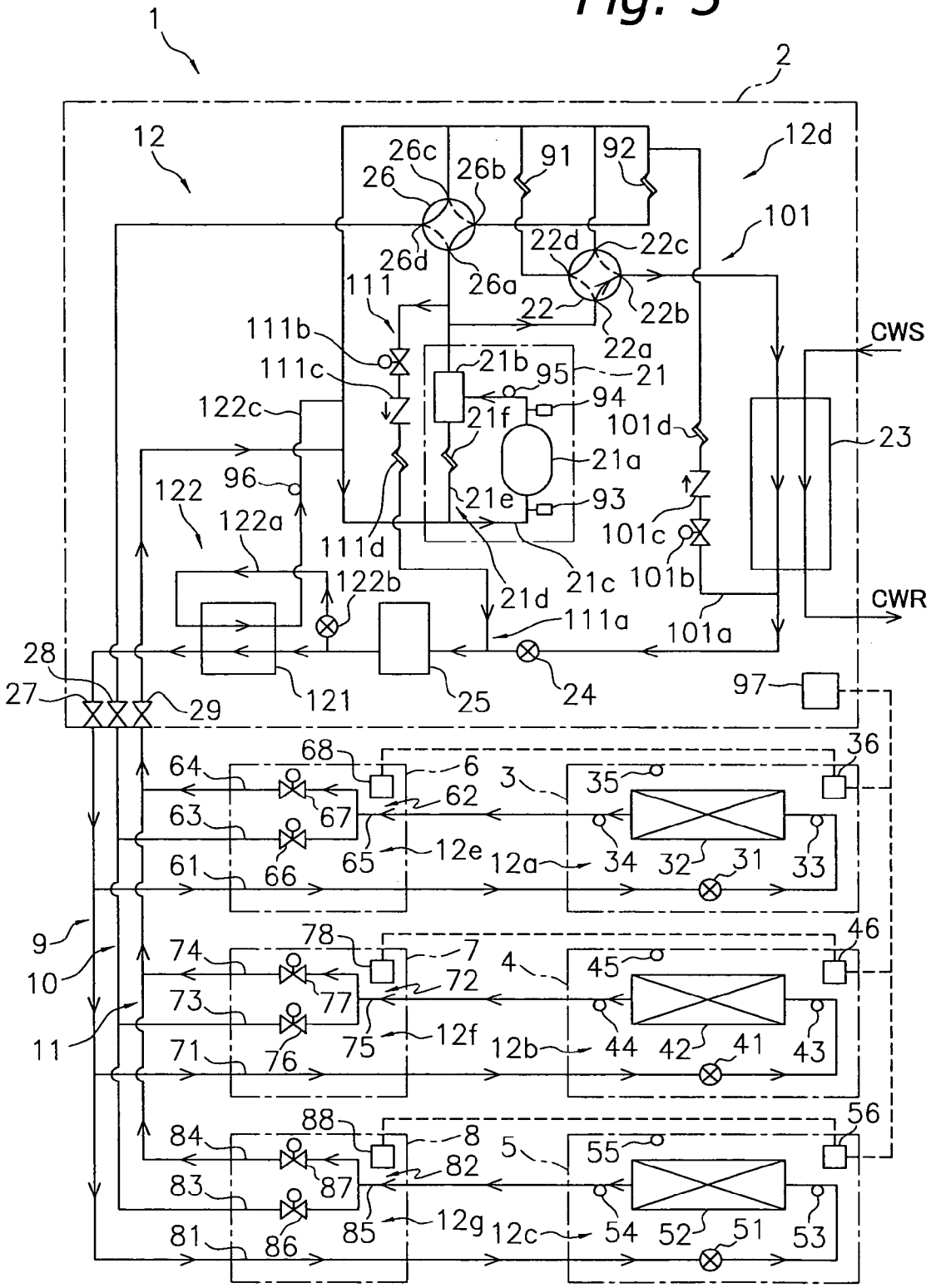

When all of the utilization units 3, 4 and 5 conduct the cooling operation, the refrigerant circuit 12 of the air conditioner 1 is configured as shown in FIG. 5 (refer to the arrows added to the refrigerant circuit 12 in FIG. 5 for the flow of the refrigerant). Specifically, in the heat source refrigerant circuit 12*d* of the heat source unit 2, the first switch mechanism 22 is switched to the condensation operating state (the state indicated by the solid lines of the first switch mechanism 22 in FIG. 5), whereby the heat source heat exchanger 23 is caused to function as a condenser. Further, the heat source expansion valve 24 is opened. It will be noted that the control valve 101*b* of the first oil returning circuit 101 is closed so that the operation of extracting, and returning to the compression mechanism 21, the refrigerating machine oil together with the refrigerant from the lower portion of the heat source heat exchanger 23 is not conducted. In the connection units 6, 7 and 8, the high-pressure gas control valves 66, 76 and 86 are closed and the low-pressure gas control valves 67, 77 and 87 are opened, whereby the utilization heat exchangers 32, 42 and 52 of the utilization units 3, 4 and 5 are caused to function as evaporators, and the utilization heat exchangers 32, 42 and 52 of the utilization units 3, 4 and 5 and the intake side of the compression mechanism 21 of the heat source unit 2 become connected via the low-pressure gas refrigerant communication pipe 11. In the utilization units 3, 4 and 5, the openings of the utilization expansion valves 31, 41 and 51 are regulated in accordance with the cooling load of each utilization unit, such as the openings being regulated on the basis of the degree of superheat of the utilization heat exchangers 32, 42 and 52 (specifically, the temperature difference between the refrigerant temperature detected by the liquid temperature sensors 33, 43 and 53 and the refrigerant temperature detected by the gas temperature sensors 34, 44 and 54), for example.

In this configuration of the refrigerant circuit 12, a large portion of the refrigerating machine oil accompanying the high-pressure gas refrigerant that has been compressed and discharged by the compressor 21*a* of the compression mechanism 21 is separated in the oil separator 21*b*, and the high-pressure gas refrigerant is sent to the first switch mechanism 22. Then, the refrigerating machine oil separated in the oil separator 21*b* is returned to the intake side of the compressor 21*a* through the second oil returning circuit 21*d*. The high-pressure gas refrigerant sent to the first switch mechanism 22 is sent to the heat source heat exchanger 23 through the first port 22*a* and the second port 22*b* of the first switch mechanism 22. Then, the high-pressure gas refrigerant sent to the heat source heat exchanger 23 is condensed in the heat source heat exchanger 23 as a result of heat exchange being conducted with water serving as a heat source. Then, the refrigerant condensed in the heat source heat exchanger 23 passes through the heat source expansion valve 24, the high-pressure gas refrigerant that has been compressed and discharged by the compression mechanism 21 merges therewith through the pressurizing circuit 111 (the details will be described later), and the refrigerant is sent to the receiver 25. Then, the refrigerant sent to the receiver 25 is temporarily accumulated inside the receiver 25 and thereafter sent to the cooler 121. Then, the refrigerant sent to the cooler 121 is cooled as a result of heat exchange being conducted with the refrigerant flowing through the cooling circuit 122 (the details will be described later). Then, the refrigerant cooled in the cooler 121 is sent to the liquid refrigerant communication pipe 9 through the liquid closing valve 27.

Then, the refrigerant sent to the liquid refrigerant communication pipe 9 is branched into three and sent to the liquid connection pipes 61, 71 and 81 of the connection units 6, 7 and 8. Then, the refrigerant sent to the liquid connection pipes 61, 71 and 81 of the connection units 6, 7 and 8 is sent to the utilization expansion valves 31, 41 and 51 of the utilization units 3, 4 and 5.

Then, the pressure of the refrigerant sent to the utilization expansion valves 31, 41 and 51 is reduced by the utilization expansion valves 31, 41 and 51, and the refrigerant is thereafter evaporated in the utilization heat exchangers 32, 42 and 52 as a result of heat exchange being conducted with the indoor air and becomes low-pressure gas refrigerant. The indoor air is cooled and supplied to the indoors. Then, the low-pressure gas refrigerant is sent to the junction gas connection pipes 65, 75 and 85 of the connection units 6, 7 and 8.

Then, the low-pressure gas refrigerant sent to the junction gas connection pipes 65, 75 and 85 is sent to the low-pressure gas refrigerant communication pipe 11 through the low-pressure gas control valves 67, 77 and 87 and the low-pressure gas connection pipes 64, 74 and 84, and merges.

Then, the low-pressure gas refrigerant that has been sent to the low-pressure gas refrigerant communication pipe 11 and merged is returned to the intake side of the compression mechanism 21 through the low-pressure gas closing valve 29. In this manner, the operation in the cooling operating mode is conducted.

At this time, there are cases where the cooling loads of the utilization units 3, 4 and 5 become extremely small. In such cases, it is necessary to reduce the refrigerant condensing ability in the heat source heat exchanger 23 of the heat source unit 2 and balance the overall cooling load of the utilization units 3, 4 and 5 (specifically, the evaporation loads of the utilization heat exchangers 32, 42 and 52). For this reason, control is conducted to reduce the condensation amount of the refrigerant in the heat source heat exchanger 23 by conducting control to reduce the opening of the heat source expansion valve 24. When control is conducted to reduce the opening of the heat source expansion valve 24, the amount of the liquid refrigerant accumulating inside the heat source heat exchanger 23 increases and the substantial heat transfer area is reduced, whereby the condensing ability becomes smaller. However, when control is conducted to reduce the opening of the heat source expansion valve 24, there is a tendency for the refrigerant pressure downstream of the heat source expansion valve 24 (specifically, between the heat source expansion valve 24 and the utilization refrigerant circuits 12*a*, 12*b* and 12*c*) to drop and become unstable, and there is a tendency for it to become difficult to stably conduct control to reduce the condensing ability of the heat source refrigerant circuit 12*d*.

However, in the air conditioner 1 of the present embodiment, the pressurizing circuit 111 is disposed which causes the high-pressure gas refrigerant compressed and discharged by the compression mechanism 21 to merge with the refrigerant whose pressure is reduced in the heat source expansion valve 24 and which is sent to the utilization refrigerant circuits 12*a*, 12*b* and 12*c*. Additionally, the control valve 111*b* of the pressurizing circuit 111 is configured to be opened during the cooling operating mode (i.e., when the first switch mechanism 22 is in the condensation operating state) such that it can cause the refrigerant to merge downstream of the heat source expansion valve 24 from the discharge side of the compression mechanism 21 through the pressurizing pipe 111*a*. For this reason, the pressure of the refrigerant downstream of the heat source expansion valve 24 can be raised by causing the high-pressure gas refrigerant to merge through the pressurizing circuit 111 downstream of the heat source expansion valve 24 while control is conducted to reduce the opening of the heat source expansion valve 24. However, when the high-pressure gas refrigerant is simply caused to merge downstream of the heat source expansion valve 24 through the pressurizing circuit 111, the high-pressure gas refrigerant merges and the refrigerant sent to the utilization refrigerant circuits 12*a*, 12*b* and 12*c* becomes a gas-liquid two-phase flow with a large gas fraction, and when the refrigerant is branched from the liquid refrigerant communication pipe 9 to the utilization refrigerant circuits 12*a*, 12*b* and 12*c*, drift arises between the utilization refrigerant circuits 12*a*, 12*b* and 12*c*.

However, in the air conditioner 1 of the present embodiment, the cooler 121 is further disposed downstream of the heat source expansion valve 24. For this reason, control is conducted to raise the refrigerant pressure downstream of the heat source expansion valve 24 by causing the high-pressure gas refrigerant to merge through the pressurizing circuit 111 downstream of the heat source expansion valve 24 while control is conducted to reduce the opening of the heat source expansion valve 24, and the refrigerant whose pressure is reduced by the heat source expansion valve 24 and which is sent to the utilization refrigerant circuits 12*a*, 12*b* and 12*c* is cooled by the cooler 121. For this reason, the gas refrigerant can be condensed, and refrigerant of a gas-liquid two-phase flow with a large gas fraction does not have to be sent to the utilization refrigerant circuits 12*a*, 12*b* and 12*c*. Further, in the air conditioner 1 of the present embodiment, because the pressurizing pipe 111*a* is connected between the heat source expansion valve 24 and the receiver 25, the high-pressure gas refrigerant merges with the refrigerant downstream of the heat source expansion valve 24, and the refrigerant whose temperature has risen as a result of the high-pressure gas refrigerant merging therewith is cooled by the cooler 121. For this reason, it is not necessary to use a low-temperature cooling source as the cooling source for cooling the refrigerant in the cooler 121, and a cooling source with a relatively high temperature can be used. Moreover, in the air conditioner 1 of the present embodiment, the cooling circuit 122 is disposed, the pressure of some of the refrigerant sent from the heat source heat exchanger 23 to the utilization refrigerant circuits 12*a*, 12*b* and 12*c* is reduced to a refrigerant pressure that can return it to the intake side of the compression mechanism 21, and this refrigerant is used as the cooling source of the cooler 121. For this reason, a cooling source can be obtained which has a sufficiently lower temperature than the temperature of the refrigerant whose pressure is reduced in the heat source expansion valve 24 and which is sent to the utilization refrigerant circuits 12*a*, 12*b* and 12*c*. For this reason, the refrigerant whose pressure is reduced in the heat source expansion valve 24 and which is sent to the utilization refrigerant circuits 12*a*, 12*b* and 12*c* can be cooled to a subcooled state. Additionally, the opening of the cooling circuit expansion valve 122*b* of the cooling circuit 122 is regulated in accordance with the flow rate and temperature of the refrigerant sent to the utilization refrigerant circuits 12*a*, 12*b* and 12*c* from downstream of the heat source expansion valve 24, such as regulating the opening on the basis of the degree of superheat of the cooler 121 (calculated from the refrigerant temperature detected by the cooling circuit outlet temperature sensor 96 disposed in the lead-out pipe 122*c* of the cooling circuit 122).

<Simultaneous Cooling and Heating Operating Mode (Evaporation Load)>

Figure 6:
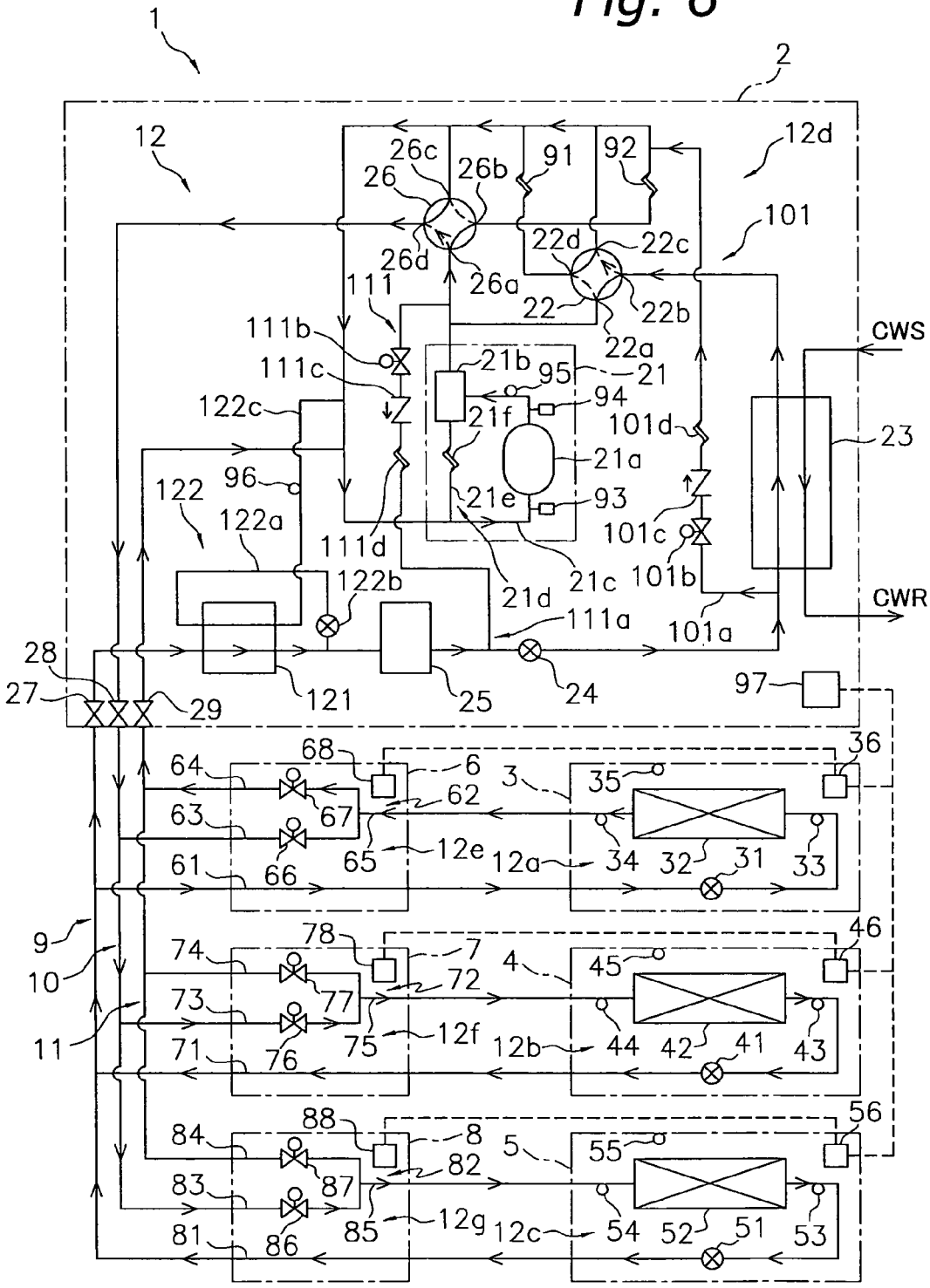

The operation will be described during the simultaneous cooling and heating operating mode where, for example, the utilization unit 3 of the utilization units 3, 4 and 5 conducts the cooling operation and the utilization units 4 and 5 conduct the heating operation, when the heat source heat exchanger 23 of the heat source unit 2 is caused to function and operate as an evaporator (evaporation operating mode). In this case, the refrigerant circuit 12 of the air conditioner 1 is configured as shown in FIG. 6 (refer to the arrows added to the refrigerant circuit 12 in FIG. 6 for the flow of the refrigerant). Specifically, in the heat source refrigerant circuit 12*d* of the heat source unit 2, similar to the aforementioned heating operating mode, the first switch mechanism 22 is switched to the evaporation operating state (the state indicated by the dotted lines of the first switch mechanism 22 in FIG. 6) and the second switch mechanism 26 is switched to the heating load requirement operating state (the state indicated by the dotted lines of the second switch mechanism 26 in FIG. 6), whereby the heat source heat exchanger 23 is caused to function as an evaporator so that the high-pressure gas refrigerant compressed and discharged in the compression mechanism 21 can be supplied to the utilization units 4 and 5 through the high-pressure gas refrigerant communication pipe 10. Further, the opening of the heat source expansion valve 24 is regulated to reduce the pressure of the refrigerant. It will be noted that the control valve 111*b* of the pressurizing circuit 111 and the cooling circuit expansion valve 122*b* of the cooling circuit 122 are closed so that the high-pressure gas refrigerant is not caused to merge with the refrigerant flowing between the heat source expansion valve 24 and the receiver 25 and the supply of the cooling source to the cooler 121 is cut off such that the refrigerant flowing between the receiver 25 and the utilization units 3, 4 and 5 is not cooled. In the connection unit 6, the high-pressure gas control valve 66 is closed and the low-pressure gas control valve 67 is opened, whereby the utilization heat exchanger 32 of the utilization unit 3 is caused to function as an evaporator, and the utilization heat exchanger 32 of the utilization unit 3 and the intake side of the compression mechanism 21 of the heat source unit 2 become connected via the low-pressure gas refrigerant communication pipe 11. In the utilization unit 3, the opening of the utilization expansion valve 31 is regulated in accordance with the cooling load of the utilization unit, such as the opening being regulated on the basis of the degree of superheat of the utilization heat exchanger 32 (specifically, the temperature difference between the refrigerant temperature detected by the liquid temperature sensor 33 and the refrigerant temperature detected by the gas temperature sensor 34), for example. In the connection units 7 and 8, the low-pressure gas control valves 77 and 87 are closed and the high-pressure gas control valves 76 and 86 are opened, whereby the utilization heat exchangers 42 and 52 of the utilization units 4 and 5 are caused to function as condensers. In the utilization units 4 and 5, the openings of the utilization expansion valves 41 and 51 are regulated in accordance with the heating load of each utilization unit, such as the openings being regulated on the basis of the degree of subcooling of the utilization heat exchangers 42 and 52 (specifically, the temperature difference between the refrigerant temperature detected by the liquid temperature sensors 43 and 53 and the refrigerant temperature detected by the gas temperature sensors 44 and 54), for example.

In this configuration of the refrigerant circuit 12, a large portion of the refrigerating machine oil accompanying the high-pressure gas refrigerant that has been compressed and discharged by the compressor 21*a* of the compression mechanism 21 is separated in the oil separator 21*b*, and the high-pressure gas refrigerant is sent to the second switch mechanism 26. Then, the refrigerating machine oil separated in the oil separator 21*b* is returned to the intake side of the compressor 21*a* through the second oil returning circuit 21*d*. The high-pressure gas refrigerant sent to the second switch mechanism 26 is sent to the high-pressure gas refrigerant communication pipe 10 through the first port 26*a* and the fourth port 26*d* of the second switch mechanism 26 and the high-pressure gas closing valve 28.

Then, the high-pressure gas refrigerant sent to the high-pressure gas refrigerant communication pipe 10 is branched into two and sent to the high-pressure gas connection pipes 73 and 83 of the connection units 7 and 8. The high-pressure gas refrigerant sent to the high-pressure gas connection pipes 73 and 83 of the connection units 7 and 8 is sent to the utilization heat exchangers 42 and 52 of the utilization units 4 and 5 through the high-pressure gas control valves 76 and 86 and the junction gas connection pipes 75 and 85.

Then, the high-pressure gas refrigerant sent to the utilization heat exchangers 42 and 52 is condensed in the utilization heat exchangers 42 and 52 of the utilization units 4 and 5 as a result of heat exchange being conducted with the indoor air. The indoor air is heated and supplied to the indoors. The refrigerant condensed in the utilization heat exchangers 42 and 52 passes through the utilization expansion valves 41 and 51 and is thereafter sent to the liquid connection pipes 71 and 81 of the connection units 7 and 8.

Then, the refrigerant sent to the liquid connection pipes 71 and 81 is sent to the liquid refrigerant communication pipe 9 and merges.

Then, some of the refrigerant that has been sent to the liquid refrigerant communication pipe 9 and merged is sent to the liquid connection pipe 61 of the connection unit 6. Then, the refrigerant sent to the liquid connection pipe 61 of the utilization unit 6 is sent to the utilization expansion valve 31 of the utilization unit 3.

Then, the pressure of the refrigerant sent to the utilization expansion valve 31 is reduced by the utilization expansion valve 31, and the refrigerant is evaporated in the utilization heat exchanger 32 as a result of heat exchange being conducted with the indoor air and becomes low-pressure gas refrigerant. The indoor air is cooled and supplied to the indoors. Then, the low-pressure gas refrigerant is sent to the junction gas connection pipe 65 of the connection unit 6.

Then, the low-pressure gas refrigerant sent to the junction gas connection pipe 65 is sent to the low-pressure gas refrigerant communication pipe 11 through the low-pressure gas control valve 67 and the low-pressure gas connection pipe 64, and merges.

Then, the low-pressure gas refrigerant sent to the low-pressure gas refrigerant communication pipe 11 is returned to the intake side of the compression mechanism 21 through the low-pressure gas closing valve 29.

The remaining refrigerant excluding the refrigerant sent from the liquid refrigerant communication pipe 9 to the connection unit 6 and the utilization unit 3 is sent to the receiver 25 through the liquid closing valve 27 and the cooler 121 of the heat source unit 2. The refrigerant sent to the receiver 25 is temporarily accumulated inside the receiver 25, and the pressure of the refrigerant is thereafter reduced by the heat source expansion valve 24. Then, the refrigerant whose pressure has been reduced by the heat source expansion valve 24 is evaporated in the heat source heat exchanger 23 as a result of heat exchange being conducted with water serving as a heat source, becomes low-pressure gas refrigerant, and is sent to the first switch mechanism 22. Then, the low-pressure gas refrigerant sent to the first switch mechanism 22 is returned to the intake side of the compression mechanism 21 through the second port 22*b* and the third port 22*c* of the first switch mechanism 22. In this manner, the operation in the simultaneous cooling and heating operating mode (evaporation load) is conducted.

At this time, there are cases where, in accordance with the overall air conditioning load of the utilization units 3, 4 and 5, an evaporation load is necessary as the heat source heat exchanger 23 but the size thereof becomes extremely small. In such cases, similar to the aforementioned heating operating mode, it is necessary to reduce the refrigerant evaporating ability in the heat source heat exchanger 23 of the heat source unit 2 and balance the overall air conditioning load of the utilization units 3, 4 and 5. In particular, there are cases where the cooling load of the utilization unit 3 and the heating loads of the utilization units 4 and 5 become about the same in the simultaneous cooling and heating operating mode, and in such cases the evaporation load of the heat source heat exchanger 23 must be extremely reduced.

However, in the air conditioner 1 of the present embodiment, because the combination of refrigerating machine oil and refrigerant that does not separate into two layers in a temperature range of 30° C. or below is used and the first oil returning circuit 101 is disposed, the accumulation of refrigerating machine oil inside the heat source heat exchanger 23 can be prevented as previously mentioned in the description of the operation of the heating operating mode.

<Simultaneous Cooling and Heating Mode (Condensation Load)>

Figure 7:
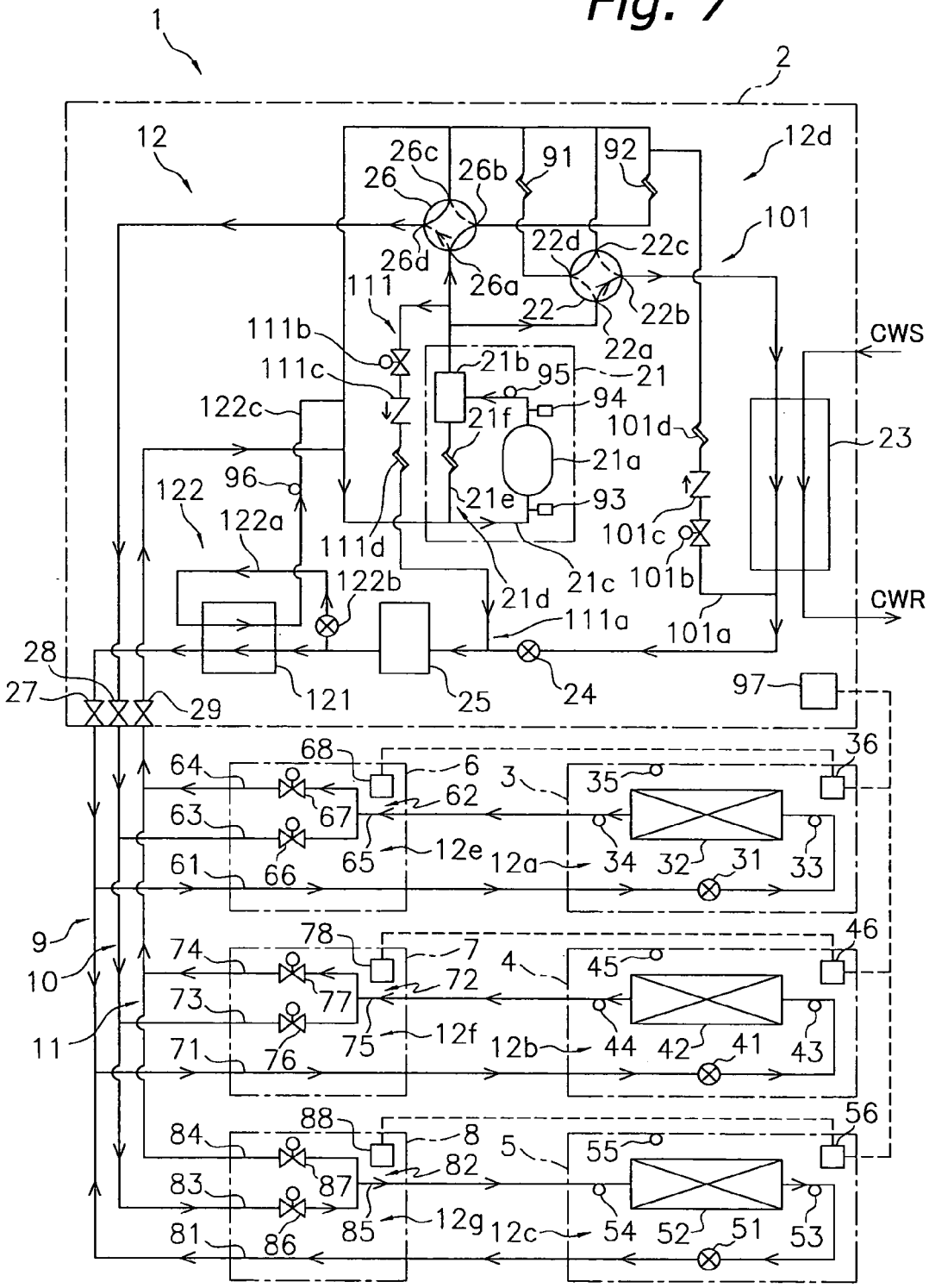

The operation will be described during the simultaneous cooling and heating operating mode where, for example, the utilization units 3 and 4 of the utilization units 3, 4 and 5 conduct the cooling operation and the utilization unit 5 conducts the heating operation, when the heat source heat exchanger 23 of the heat source unit 2 is caused to function and operate as a condenser in accordance with the overall air conditioning load of the utilization units 3, 4 and 5 (condensation operating mode). In this case, the refrigerant circuit 12 of the air conditioner 1 is configured as shown in FIG. 7 (refer to the arrows added to the refrigerant circuit 12 in FIG. 7 for the flow of the refrigerant). Specifically, in the heat source refrigerant circuit 12*d* of the heat source unit 2, the first switch mechanism 22 is switched to the condensation operating state (the state indicated by the solid lines of the first switch mechanism 22 in FIG. 7) and the second switch mechanism 26 is switched to the heating load requirement operating state (the state indicated by the dotted lines of the second switch mechanism 26 in FIG. 7), whereby the heat source heat exchanger 23 is caused to function as an evaporator so that the high-pressure gas refrigerant compressed and discharged in the compression mechanism 21 can be supplied to the utilization unit 5 through the high-pressure gas refrigerant communication pipe 10. Further, the heat source expansion valve 24 is opened. It will be noted that the control valve 101*b* of the first oil returning circuit 101 is closed so that the operation of extracting, and returning to the compression mechanism 21, the refrigerating machine oil together with the refrigerant from the lower portion of the heat source heat exchanger 23 is not conducted. In the connection units 6 and 7, the high-pressure gas control valves 66 and 76 are closed and the low-pressure gas control valves 67 and 77 are opened, whereby the utilization heat exchangers 32 and 42 of the utilization units 3 and 4 are caused to function as evaporators, and the utilization heat exchangers 32 and 42 of the utilization units 3 and 4 and the intake side of the compression mechanism 21 of the heat source unit 2 become connected via the low-pressure gas refrigerant communication pipe 11. In the utilization units 3 and 4, the openings of the utilization expansion valves 31 and 41 are regulated in accordance with the cooling load of each utilization unit, such as the openings being regulated on the basis of the degree of superheat of the utilization heat exchangers 32 and 42 (specifically, the temperature difference between the refrigerant temperature detected by the liquid temperature sensors 33 and 43 and the refrigerant temperature detected by the gas temperature sensors 34 and 44), for example. In the connection unit 8, the low-pressure gas control valve 87 is closed and the high-pressure gas control valve 86 is opened, whereby the utilization heat exchanger 52 of the utilization unit 5 is caused to function as a condenser. In the utilization unit 5, the opening of the utilization expansion valve 51 is regulated in accordance with the heating load of the utilization unit, such as the opening being regulated on the basis of the degree of subcooling of the utilization heat exchanger 52 (specifically, the temperature difference between the refrigerant temperature detected by the liquid temperature sensor 53 and the refrigerant temperature detected by the gas temperature sensor 54), for example.

In this configuration of the refrigerant circuit 12, a large portion of the refrigerating machine oil accompanying the high-pressure gas refrigerant that has been compressed and discharged by the compressor 21*a* of the compression mechanism 21 is separated in the oil separator 21*b*, and the high-pressure gas refrigerant is sent to the first switch mechanism 22 and the second switch mechanism 26. Then, the refrigerating machine oil separated in the oil separator 21*b* is returned to the intake side of the compressor 21*a* through the second oil returning circuit 21*d*. Then, the high-pressure gas refrigerant sent to the first switch mechanism 22 of the high-pressure gas refrigerant that has been compressed and discharged by the compression mechanism 21 is sent to the heat source heat exchanger 23 through the first port 22*a* and the second port 22*b* of the first switch mechanism 22. Then, the high-pressure gas refrigerant sent to the heat source heat exchanger 23 is condensed in the heat source heat exchanger 23 as a result of heat exchange being conducted with water serving as a heat source. Then, the refrigerant condensed in the heat source heat exchanger 23 passes through the heat source expansion valve 24, the high-pressure gas refrigerant that has been compressed and discharged by the compression mechanism 21 merges therewith through the pressurizing circuit 111 (the details will be described later), and the refrigerant is sent to the receiver 25. Then, the refrigerant sent to the receiver 25 is temporarily accumulated inside the receiver 25 and sent to the cooler 121. Then, the refrigerant sent to the cooler 121 is cooled as a result of heat exchange being conducted with the refrigerant flowing through the cooling circuit 122 (the details will be described later). Then, the refrigerant cooled in the cooler 121 is sent to the liquid refrigerant communication pipe 9 through the liquid closing valve 27.

The high-pressure gas refrigerant sent to the second switch mechanism 26 of the high-pressure gas refrigerant that has been compressed and discharged by the compression mechanism 21 is sent to the high-pressure gas refrigerant communication pipe 10 through the first port 26*a* and the second port 26*d* of the second switch mechanism 26 and the high-pressure gas closing valve 28.

Then, the high-pressure gas refrigerant sent to the high-pressure gas refrigerant communication pipe 10 is sent to the high-pressure gas connection pipe 83 of the connection unit 8. The high-pressure gas refrigerant sent to the high-pressure gas connection pipe 83 of the connection unit 8 is sent to the utilization heat exchanger 52 of the utilization unit 5 through the high-pressure gas control valve 86 and the junction gas connection pipe 85.

Then, the high-pressure gas refrigerant sent to the utilization heat exchanger 52 is condensed in the utilization heat exchanger 52 of the utilization unit 5 as a result of heat exchange being conducted with the indoor air. The indoor air is heated and supplied to the indoors. The refrigerant condensed in the utilization heat exchanger 52 passes through the utilization expansion valve 51 and is thereafter sent to the liquid connection pipe 81 of the connection unit 8.

Then, the refrigerant sent to the liquid connection pipe 81 is sent to the liquid refrigerant communication pipe 9 and merges with the refrigerant sent to the liquid refrigerant communication pipe 9 through the first switch mechanism 22, the heat source heat exchanger 23, the heat source expansion valve 24, the receiver 25, the cooler 121 and the liquid closing valve 27.

Then, the refrigerant flowing through the liquid refrigerant communication pipe 9 is branched into two and sent to the liquid connection pipes 61 and 71 of the connection units 6 and 7. Then, the refrigerant sent to the liquid connection pipes 61 and 71 of the connection units 6 and 7 is sent to the utilization expansion valves 31 and 41 of the utilization units 3 and 4.

Then, the pressure of refrigerant sent to the utilization expansion valves 31 and 41 is reduced by the utilization expansion valves 31 and 41, and the refrigerant is thereafter evaporated in the utilization heat exchangers 32 and 42 as a result of heat exchange being conducted with the indoor air and becomes low-pressure gas refrigerant. The indoor air is cooled and supplied to the indoors. Then, the low-pressure gas refrigerant is sent to the junction gas connection pipes 65 and 75 of the connection units 6 and 7.

Then, the low-pressure gas refrigerant sent to the junction gas connection pipes 65 and 75 is sent to the low-pressure gas refrigerant communication pipe 11 through the low-pressure gas control valves 67 and 77 and the low-pressure gas connection pipes 64 and 74, and merges.

Then, the low-pressure gas refrigerant sent to the low-pressure gas refrigerant communication pipe 11 is returned to the intake side of the compression mechanism 21 through the low-pressure gas closing valve 29. In this manner, the operation in the simultaneous cooling and heating operating mode (condensation load) is conducted.

At this time, there are cases where, in accordance with the overall air conditioning load of the utilization units 3, 4 and 5, a condensation load is necessary for the heat source heat exchanger 23 but the size thereof becomes extremely small. In such cases, similar to the aforementioned cooling operating mode, it is necessary to reduce the refrigerant condensing ability in the heat source heat exchanger 23 of the heat source unit 2 and balance the overall air conditioning load of the utilization units 3, 4 and 5. In particular, there are cases where the cooling loads of the utilization units 3 and 4 and the heating load of the utilization unit 5 become about the same in the simultaneous cooling and heating operating mode, and in such cases the condensation load of the heat source heat exchanger 23 must be made extremely small.

However, in the air conditioner 1 of the present embodiment, control is conducted to raise the pressure of the refrigerant downstream of the heat source expansion valve 24 by causing the high-pressure gas refrigerant to merge through the pressurizing circuit 111 downstream of the heat source expansion valve 24 while reducing the opening of the heat source expansion valve 24, and the refrigerant whose pressure is reduced by the heat source expansion valve 24 and which is sent to the utilization refrigerant circuits 12*a* and 12*b* is cooled by the cooler 121. For this reason, the gas refrigerant can be condensed, and refrigerant of a gas-liquid two-phase flow with a large gas fraction does not have to be sent to the utilization refrigerant circuits 12*a* and 12*b*.

(3) Characteristics of the Air Conditioner

The air conditioner 1 of the present embodiment has the following characteristics.

(A)

The air conditioner 1 of the present embodiment is disposed with the refrigerant circuit 12 configured by the interconnection of the heat source refrigerant circuit 12*d*, which includes the heat source heat exchanger 23 configured such that the refrigerant flows in from below and flows out from above when the heat source heat exchanger 23 functions as an evaporator, and the utilization refrigerant circuits 12*a*, 12*b* and 12*c*, and a combination of refrigerating machine oil and refrigerant that does not separate into two layers in a temperature range of 30° C. or below is used as the refrigerating machine oil and the refrigerant used in the refrigerant circuit 12. Here, the evaporation temperature of the refrigerant in the heat source heat exchanger 23 is a temperature of 30° C. or below when water and air are used as the heat sources. For this reason, in the air conditioner 1, the refrigerating machine oil does not accumulate in a state where it floats on the surface of the refrigerant inside the heat source heat exchanger 23, but rather accumulates inside the heat source heat exchanger 23 in a state where it is mixed with the refrigerant. Additionally, the refrigerating machine oil accumulating inside the heat source heat exchanger 23 is returned to the intake side of the compression mechanism 21 together with the refrigerant by the first oil returning circuit 101 connected to the lower portion of the heat source heat exchanger 23. For this reason, it becomes unnecessary to maintain the level of the refrigerant inside the heat source heat exchanger at a constant level or more in order to prevent the refrigerating machine oil from accumulating inside the heat source heat exchanger, as in conventional air conditioners.

Thus, in the air conditioner 1, even when control is conducted to reduce the evaporating ability of the heat source heat exchanger 23 by reducing the opening of the heat source expansion valve 24 in accordance with the air conditioning load of the utilization refrigerant circuits 12*a*, 12*b* and 12*c* so that as a result the level of the refrigerant inside the heat source heat exchanger 23 drops, the refrigerating machine oil does not accumulate inside the heat source heat exchanger 23. For this reason, the control width when the evaporating ability of the heat source heat exchanger 23 is controlled with a heat source expansion valve can be expanded.

Additionally, in the air conditioner 1, it becomes unnecessary to conduct control, as in conventional air conditioners disposed with plural heat source heat exchangers, to reduce the evaporating ability by closing some of plural heat source expansion valves to reduce the number of heat source heat exchangers functioning as evaporators when the heat source heat exchangers are caused to function as evaporators or to reduce the evaporating ability by causing some of the heat source heat exchangers to function as condensers to offset the evaporating ability of the heat source heat exchangers functioning as evaporators. For this reason, a wide control width of the evaporating ability can be obtained by a single heat source heat exchanger.

Thus, because simplification of the heat source heat exchanger becomes possible in an air conditioner where simplification of the heat source heat exchangers could not be realized by restricting the control width of the control of the evaporating ability of the heat source heat exchangers, increases in the number of parts and cost that had occurred in conventional air conditioners as a result of disposing plural heat source heat exchangers can be prevented. Further, the problem of the COP becoming poor in an operating condition where, when some of plural heat source heat exchangers are caused to function as condensers to reduce the evaporating ability, the amount of refrigerant compressed in the compression mechanism increases in correspondence to the amount of refrigerant condensed by the heat source heat exchangers and the air conditioning load of the utilization refrigerant circuits is small can be eliminated.

(B)

In the air conditioner 1 of the present embodiment, the control valve 101*b* is disposed in the first oil returning circuit 101, and the air conditioner 1 operates in a state where the control valve 101*b* is closed when the heat source heat exchanger 23 is caused to function as a condenser, whereby the amount of refrigerant sent to the utilization refrigerant circuits 12*a*, 12*b* and 12*c* after being condensed in the heat source heat exchanger 23 can be prevented from being reduced.

Further, in the air conditioner 1, it is not necessary to use the first oil returning circuit 101 until the level of the refrigerant inside the heat source heat exchanger 23 reaches a constant level or more where there is no accumulation of refrigerating machine oil. For this reason, the opening of the heat source expansion valve 24 corresponding to a level of the refrigerant where accumulation of the refrigerating machine oil can occur inside the heat source heat exchanger 23 is set as a predetermined opening, and the control valve 101*b* is opened and the air conditioner 1 operates only when the opening of the heat source expansion valve 24 becomes equal to or less than this predetermined opening, whereby the amount of refrigerant sent to the compression mechanism 21 can be prevented from increasing without the refrigerant being evaporated in the heat source heat exchanger 23.

(C)

In the air conditioner 1 of the present embodiment, a plate-type heat exchanger is used as the heat source heat exchanger 23, and in terms of the structure thereof, it is difficult for the refrigerating machine oil accumulating in a state where it floats on the surface of the refrigerant to be extracted from the vicinity of the surface of the refrigerant in order to prevent the refrigerating machine oil from accumulating inside the heat source heat exchanger 23. However, in the air conditioner 1 of the present embodiment, it suffices simply for the refrigerating machine oil to accumulate inside the heat source heat exchanger 23 in a state where it is mixed with the refrigerant and for the refrigerating machine oil accumulating inside the heat source exchanger 23 to be extracted from the lower portion of the heat source heat exchanger 23 together with the refrigerant. For this reason, it is easy to dispose the first oil returning circuit 101 even when a plate-type heat exchanger is used.

(D)

In the air conditioner 1 of the present embodiment, the high-pressure gas refrigerant merges from the pressurizing circuit 111 and the refrigerant to be sent to the utilization refrigerant circuits 12*a*, 12*b* and 12*c* is pressurized so that the refrigerant pressure downstream of the heat source expansion valve 24 rises when the pressure of the refrigerant that has been condensed in the heat source heat exchanger 23 functioning as a condenser is reduced by the heat source expansion valve 24 and the refrigerant is sent to the utilization refrigerant circuits 12*a*, 12*b* and 12*c*. Here, when the high-pressure gas refrigerant is simply caused to merge as in conventional air conditioners, the refrigerant sent to the utilization refrigerant circuits 12*a*, 12*b* and 12*c* becomes a gas-liquid two-phase flow with a large gas fraction so that as a result the opening of the heat source expansion valve 24 cannot be sufficiently reduced. However, in the air conditioner 1, the refrigerant whose pressure is reduced by the heat source expansion valve 24 and which is sent to the utilization refrigerant circuits 12*a*, 12*b* and 12*c* is cooled by the cooler 121. For this reason, the gas refrigerant can be condensed, and refrigerant of a gas-liquid two-phase flow with a large gas fraction does not have to be sent to the utilization refrigerant circuits 12*a*, 12*b* and 12*c*.

Thus, in the air conditioner 1, even if control is conducted to reduce the condensing ability of the heat source heat exchanger 23 by reducing the opening of the heat source expansion valve 24 in accordance with the air conditioning load of the utilization refrigerant circuits 12*a*, 12*b* and 12*c* and control is conducted with the pressurizing circuit 111 to merge the high-pressure gas refrigerant and pressurize the refrigerant sent to the utilization refrigerant circuits 12*a*, 12*b* and 12*c*, refrigerant of a gas-liquid two-phase flow with a large gas fraction does not have to be sent to the utilization refrigerant circuits 12*a*, 12*b* and 12*c*. For this reason, the control width when the evaporating ability of the heat source heat exchanger 23 is controlled by the heat source expansion valve 24 can be expanded.

Additionally, in the air conditioner 1, it becomes unnecessary to conduct control, as in conventional air conditioners disposed with plural heat source heat exchangers, to reduce the evaporating ability by closing some of plural heat source expansion valves to reduce the number of heat source heat exchangers functioning as evaporators when the heat source heat exchangers are caused to function as condensers or to reduce the evaporating ability by causing some of the heat source heat exchangers to function as condensers to offset the evaporating ability of the heat source heat exchangers functioning as evaporators. For this reason, a wide control width of the condensing ability can be obtained by a single heat source heat exchanger.

Thus, because simplification of the heat source heat exchanger becomes possible in an air conditioner where simplification of the heat source heat exchangers could not be realized by restricting the control width of the control of the condensing ability of the heat source heat exchangers, increases in the number of parts and cost that had occurred in conventional air conditioners as a result of disposing plural heat source heat exchangers can be prevented. Further, the problem of the COP becoming poor in an operating condition where, when some of plural heat source heat exchangers are caused to function as evaporators to reduce the condensing ability, the amount of refrigerant compressed in the compression mechanism increases in correspondence to the amount of refrigerant condensed by the heat source heat exchangers and the air conditioning load of the utilization refrigerant circuits is small can be eliminated.

(E)

In the air conditioner 1 of the present embodiment, because the pressurizing circuit 111 is connected between the heat source expansion valve 24 and the cooler 121 such that the high-pressure gas refrigerant merges, refrigerant whose temperature has become higher as a result of the high-pressure gas refrigerant merging therewith becomes cooled by the cooler 121. Thus, it is not necessary to use a low-temperature cooling source as the cooling source for cooling the refrigerant in the cooler 121, and a cooling source with a relatively high temperature can be used.

Further, in the air conditioner 1, because refrigerant whose pressure is reduced to a refrigerant pressure that can return, to the intake side of the compression mechanism 21, some of the refrigerant sent from downstream of the heat source expansion valve 24 to the utilization refrigerant circuits 12*a*, 12*b* and 12*c* is used as the cooling source of the cooler 121, a cooling source with a sufficiently lower temperature than the temperature of the refrigerant sent from downstream of the heat source expansion valve 24 to the utilization refrigerant circuits 12*a*, 12*b* and 12*c* can be obtained. Thus, the refrigerant sent from downstream of the heat source expansion valve 24 to the utilization refrigerant circuits 12*a*, 12*b* and 12*c* can be cooled to a subcooled state.

(F)

In the air conditioner 1 of the present embodiment, water, of which a constant amount is supplied without relation to the control of the flow rate of the refrigerant flowing through the heat source heat exchanger 23, is used, and the evaporating ability in the heat source heat exchanger 23 cannot be controlled by controlling the water amount. However, in the air conditioner 1, because the control width when the evaporating ability or the condensing ability of the heat source heat exchanger 23 is controlled by the heat source expansion valve 24 is expanded, the control width when controlling the evaporating ability of the heat source heat exchanger 23 can be ensured even if the water amount is not controlled.

(4) Modification 1

Figure 8:
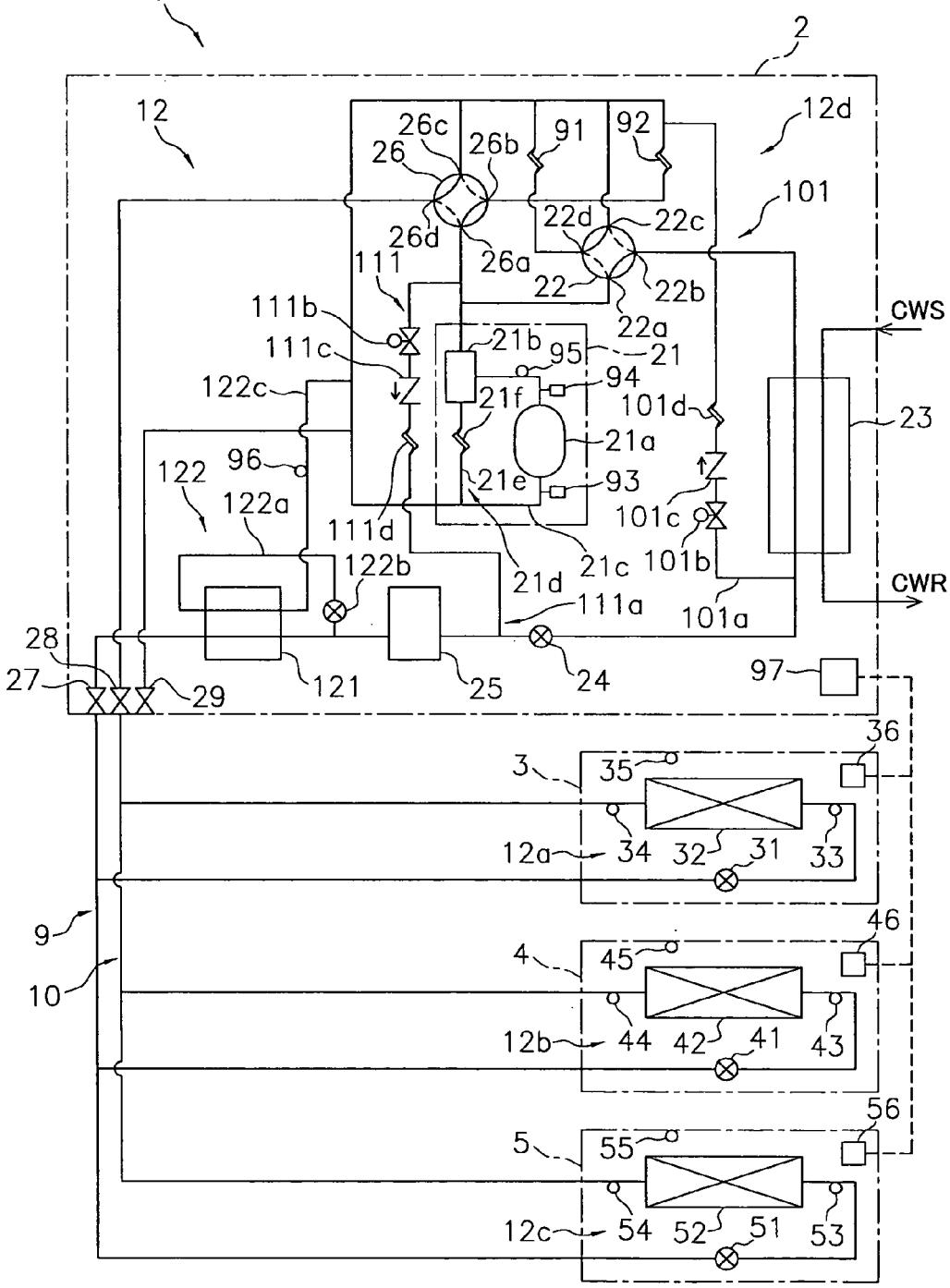

In the aforementioned air conditioner 1, the heat source unit 2 and the utilization units 3, 4 and 5 are connected via the refrigerant communication pipes 9, 10 and 11 and the connection units 6, 7 and 8 in order to configure an air conditioner capable of simultaneous cooling and heating. However, as shown in FIG. 8, the heat source unit 2 and the utilization units 3, 4 and 5 may also be connected via only the refrigerant communication pipes 9 and 10 in order to configure an air conditioner capable of simultaneous cooling and heating. Specifically, the air conditioner 1 of the present modification is configured such that the low-pressure gas refrigerant communication pipe 11 and the connection units 6, 7 and 8 necessary for making the air conditioner capable of simultaneous cooling and heating are omitted, the utilization units 3, 4 and 5 are directly connected to the liquid refrigerant communication pipe 9 and the high-pressure gas refrigerant communication pipe 10, and by the switching of the second switch mechanism 26, the high-pressure gas refrigerant communication pipe 10 is caused to function as a pipe through which flows the low-pressure gas refrigerant returned to the heat source unit 2 from the utilization units 3, 4 and 5, and the high-pressure gas refrigerant communication pipe 10 is caused to function as a pipe through which flows the high-pressure gas refrigerant supplied to the utilization units 3, 4 and 5 from the heat source unit 2.

Next, the operation (the heating operating mode and the cooling operating mode) of the air conditioner 1 of the present modification will be described.

Figure 9:
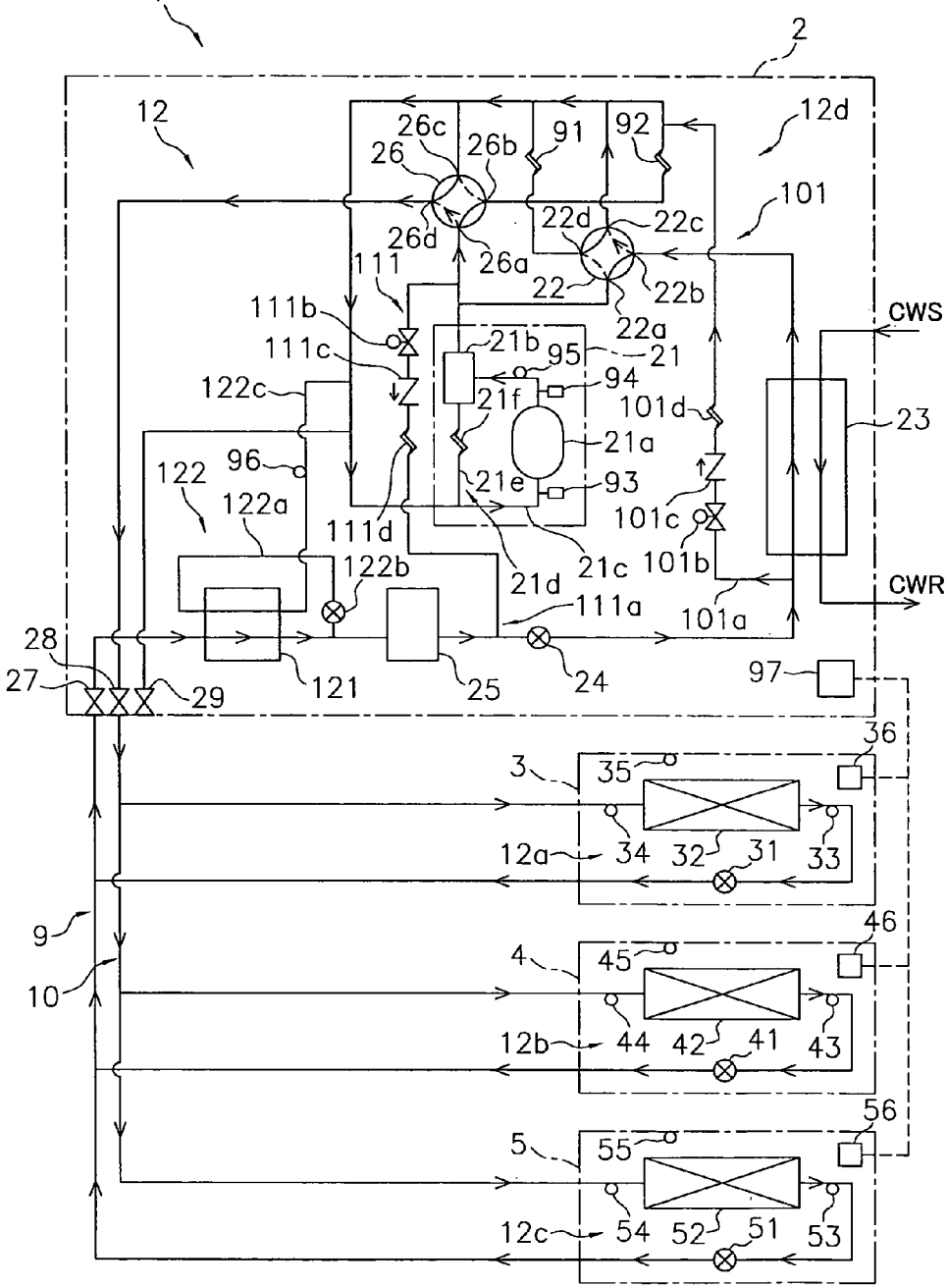

First, the heating operating mode will be described. When all of the utilization units 3, 4 and 5 conduct the heating operation, the refrigerant circuit 12 of the air conditioner 1 is configured as shown in FIG. 9 (refer to the arrows added to the refrigerant circuit 12 in FIG. 9 for the flow of the refrigerant). Specifically, in the heat source refrigerant circuit 12*d* of the heat source unit 2, the first switch mechanism 22 is switched to the evaporation operating state (the state indicated by the dotted lines of the first switch mechanism 22 in FIG. 9) and the second switch mechanism 26 is switched to the heating load requirement operating state (the state indicated by the dotted lines of the second switch mechanism 26 in FIG. 9), whereby the heat source heat exchanger 23 is caused to function as an evaporator so that the high-pressure gas refrigerant that has been compressed in the compression mechanism 21 and discharged can be supplied to the utilization units 3, 4 and 5 through the high-pressure gas refrigerant communication pipe 10. Further, the opening of the heat source expansion valve 24 is regulated to reduce the pressure of the refrigerant. It will be noted that the control valve 111*b* of the pressurizing circuit 111 and the cooling circuit expansion valve 122*b* of the cooling circuit 122 are closed such that the high-pressure gas refrigerant is not caused to merge with the refrigerant flowing between the heat source expansion valve 24 and the receiver 25 and the supply of the cooling source to the cooler 121 is cut off so that the refrigerant flowing between the receiver 25 and the utilization units 3, 4 and 5 is not cooled. In the utilization units 3, 4 and 5, the openings of the utilization expansion valves 31, 41 and 51 are regulated in accordance with the heating load of each utilization unit, such as the openings being regulated on the basis of the degree of subcooling of the utilization heat exchangers 32, 42 and 52 (specifically, the temperature difference between the refrigerant temperature detected by the liquid temperature sensors 33, 43 and 53 and the refrigerant temperature detected by the gas temperature sensors 34, 44 and 54), for example.

In this configuration of the refrigerant circuit 12, a large portion of the refrigerating machine oil accompanying the high-pressure gas refrigerant that has been compressed and discharged by the compressor 21*a* of the compression mechanism 21 is separated in the oil separator 21*b*, and the high-pressure gas refrigerant is sent to the second switch mechanism 26. Then, the refrigerating machine oil separated in the oil separator 21*b* is returned to the intake side of the compressor 21*a* through the second oil returning circuit 21*d*. The high-pressure gas refrigerant sent to the second switch mechanism 26 is sent to the high-pressure gas refrigerant communication pipe 10 through the first port 26*a* and the fourth port 26*d* of the second switch mechanism 26 and the high-pressure gas closing valve 28.

Then, the high-pressure gas refrigerant sent to the high-pressure gas refrigerant communication pipe 10 is branched into three and sent to the utilization heat exchangers 32, 42 and 52 of the utilization units 3, 4 and 5.

Then, the high-pressure gas refrigerant sent to the utilization heat exchangers 32, 42 and 52 is condensed in the utilization heat exchangers 32, 42 and 52 of the utilization units 3, 4 and 5 as a result of heat exchange being conducted with the indoor air. The indoor air is heated and supplied to the indoors. The refrigerant condensed in the utilization heat exchangers 32, 42 and 52 passes through the utilization expansion valves 31, 41 and 51, is thereafter sent to the liquid refrigerant communication pipe 9, and merges.

Then, the refrigerant that has been sent to the liquid refrigerant communication pipe 9 and merged is sent to the receiver 25 through the liquid closing valve 27 and the cooler 121 of the heat source unit 2. The refrigerant sent to the receiver 25 is temporarily accumulated inside the receiver 25, and the pressure of the refrigerant is thereafter reduced by the heat source expansion valve 24. Then, the refrigerant whose pressure has been reduced by the heat source expansion valve 24 is evaporated in the heat source heat exchanger 23 as a result of heat exchange being conducted with water serving as a heat source, becomes low-pressure gas refrigerant, and is sent to the first switch mechanism 22. Then, the low-pressure gas refrigerant sent to the first switch mechanism 22 is returned to the intake side of the compression mechanism 21 through the second port 22*b* and the third port 22*c* of the first switch mechanism 22. In this manner, the operation in the heating operating mode is conducted.

In this case also, there are cases where the heating loads of the utilization units 3, 4 and 5 become extremely small, but because the combination of the refrigerating machine oil and the refrigerant that does not separate into two layers in a temperature range of 30° C. or below is used and the first oil returning circuit 101 is disposed, accumulation of the refrigerating machine oil inside the heat source heat exchanger 23 can be prevented in the same manner as in the aforementioned heating operating mode of the air conditioner configured to be capable of simultaneous cooling and heating.

Figure 10:
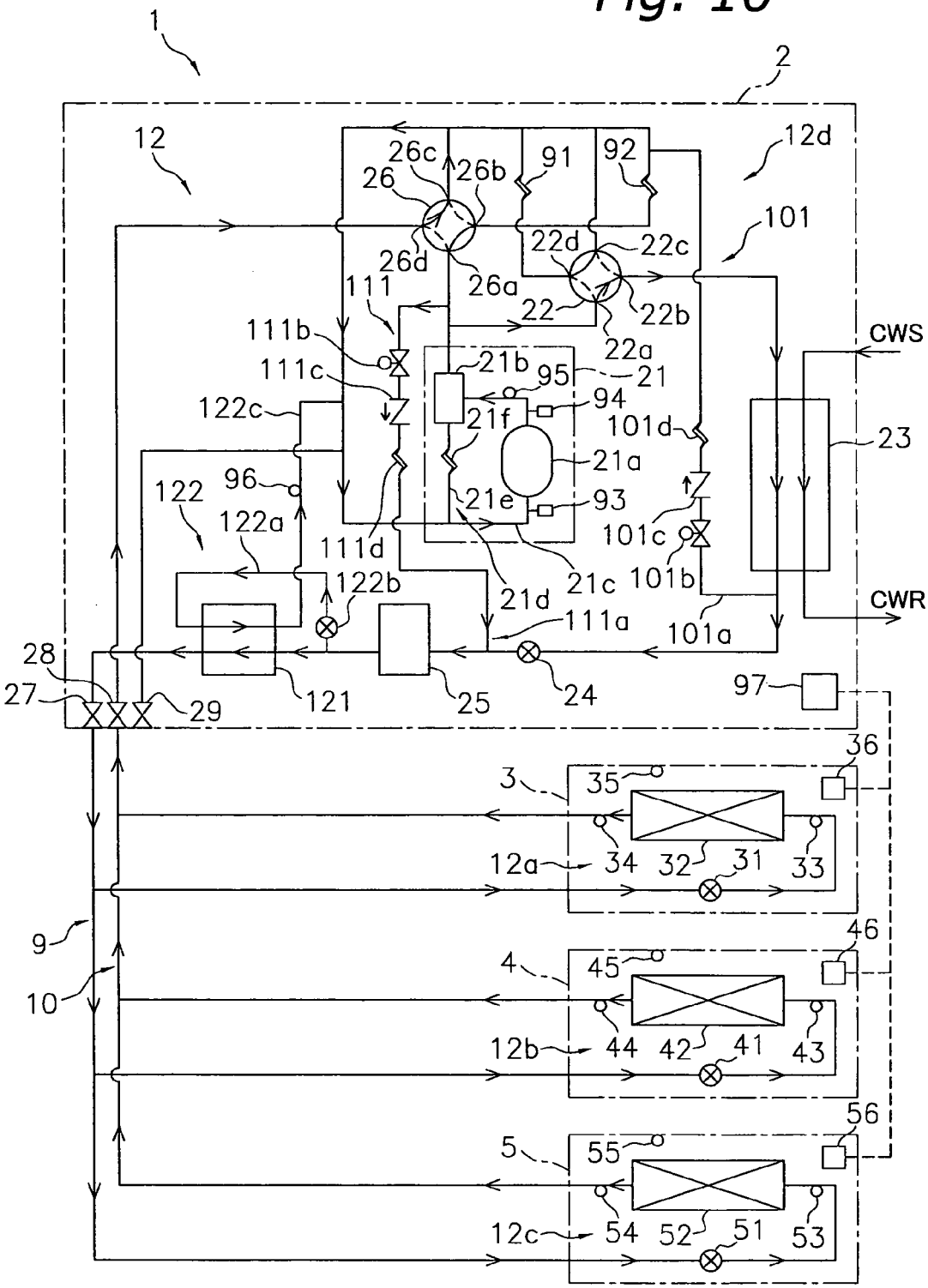

Next, the cooling operating mode will be described. When all of the utilization units 3, 4 and 5 conduct the cooling operation, the refrigerant circuit 12 of the air conditioner 1 is configured as shown in FIG. 10 (refer to the arrows added to the refrigerant circuit 12 in FIG. 10 for the flow of the refrigerant). Specifically, in the heat source refrigerant circuit 12*d* of the heat source unit 2, the first switch mechanism 22 is switched to the condensation operating state (the state indicated by the solid lines of the first switch mechanism 22 in FIG. 10) and the second switch mechanism 26 is switched to the cooling/heating switching time cooling operating state (the state indicated by the solid lines of the second switch mechanism 26 in FIG. 10), whereby the heat source heat exchanger 23 is caused to function as a condenser so that the low-pressure gas refrigerant returned to the heat source unit 2 from the utilization units 3, 4 and 5 through the high-pressure gas refrigerant communication pipe 10 can be sent to the intake side of the compression mechanism 21. Further, the heat source expansion valve 24 is opened. It will be noted that the control valve 101*b* of the first oil returning circuit 101 is closed so that the operation of extracting, and returning to the compression mechanism 21, the refrigerating machine oil together with the refrigerant from the lower portion of the heat source heat exchanger 23 is not conducted. In the utilization units 3, 4 and 5, the openings of the utilization expansion valves 31, 41 and 51 are regulated in accordance with the cooling load of each utilization unit, such as the openings being regulated on the basis of the degree of superheat of the utilization heat exchangers 32, 42 and 52 (specifically, the temperature difference between the refrigerant temperature detected by the liquid temperature sensors 33, 43 and 53 and the refrigerant temperature detected by the gas temperature sensors 34, 44 and 54), for example.

In this configuration of the refrigerant circuit 12, a large portion of the refrigerating machine oil accompanying the high-pressure gas refrigerant that has been compressed and discharged by the compressor 21*a* of the compression mechanism 21 is separated in the oil separator 21*b*, and the high-pressure gas refrigerant is sent to the first switch mechanism 22. Then, the refrigerating machine oil separated in the oil separator 21*b* is returned to the intake side of the compressor 21*a* through the second oil returning circuit 21*d*. Then, the high-pressure gas refrigerant sent to the first switch mechanism 22 is sent to the heat source heat exchanger 23 through the first port 22*a* and the second port 22*b* of the first switch mechanism 22. Then, the high-pressure gas refrigerant sent to the heat source heat exchanger 23 is condensed in the heat source heat exchanger 23 as a result of heat exchange being conducted with water serving as a heat source. Then, the refrigerant condensed in the heat source heat exchanger 23 passes through the heat source expansion valve 24, the high-pressure gas refrigerant that has been compressed and discharged by the compression mechanism 21 through the pressurizing circuit 111 merges therewith, and the refrigerant is sent to the receiver 25. Then, the refrigerant sent to the receiver 25 is temporarily accumulated inside the receiver 25 and thereafter sent to the cooler 121. Then, the refrigerant sent to the cooler 121 is cooled as a result of heat exchange being conducted with the refrigerant flowing through the cooling circuit 122. Then, the refrigerant cooled in the cooler 121 is sent to the liquid refrigerant communication pipe 9 through the liquid closing valve 27.

Then, the refrigerant sent to the liquid refrigerant communication pipe 9 is branched into three and sent to the utilization expansion valves 31, 41 and 51 of the utilization units 3, 4 and 5.

Then, the pressure of the refrigerant sent to the utilization expansion valves 31, 41 and 51 is reduced by the utilization expansion valves 31, 41 and 51, and the refrigerant is thereafter evaporated in the utilization heat exchangers 32, 42 and 52 as a result of heat exchange being conducted with the indoor air and becomes low-pressure gas refrigerant. The indoor air is cooled and supplied to the indoors. Then, the low-pressure gas refrigerant is sent to the high-pressure gas refrigerant communication pipe 10 and merges.

Then, the low-pressure gas refrigerant that has been sent to the high-pressure gas refrigerant communication pipe 10 and merged is returned to the intake side of the compression mechanism 21 through the high-pressure gas closing valve 28 and the fourth port 26*d* and the third port 26*c* of the second switch mechanism 26. In this manner, the operation in the cooling operating mode is conducted.

In this case also, there are cases where the cooling loads of the utilization units 3, 4 and 5 become extremely small, but control is conducted to raise the pressure of the refrigerant downstream of the heat source expansion valve 24 by causing the high-pressure gas refrigerant to merge through the pressurizing circuit 111 downstream of the heat source expansion valve 24 while conducting control to reduce the opening of the heat source expansion valve 24, and the refrigerant whose pressure is reduced by the heat source expansion valve 24 and which is sent to the utilization refrigerant circuits 12*a*, 12*b* and 12*c* is cooled by the cooler 121. For this reason, in the same manner as the aforementioned cooling operating mode of the air conditioner configured to be capable of simultaneous cooling and heating, the gas refrigerant can be condensed, and refrigerant of a gas-liquid two-phase flow with a large gas fraction does not have to be sent to the utilization refrigerant circuits 12*a*, 12*b* and 12*c*.

(5) Modification 2

Figure 11:
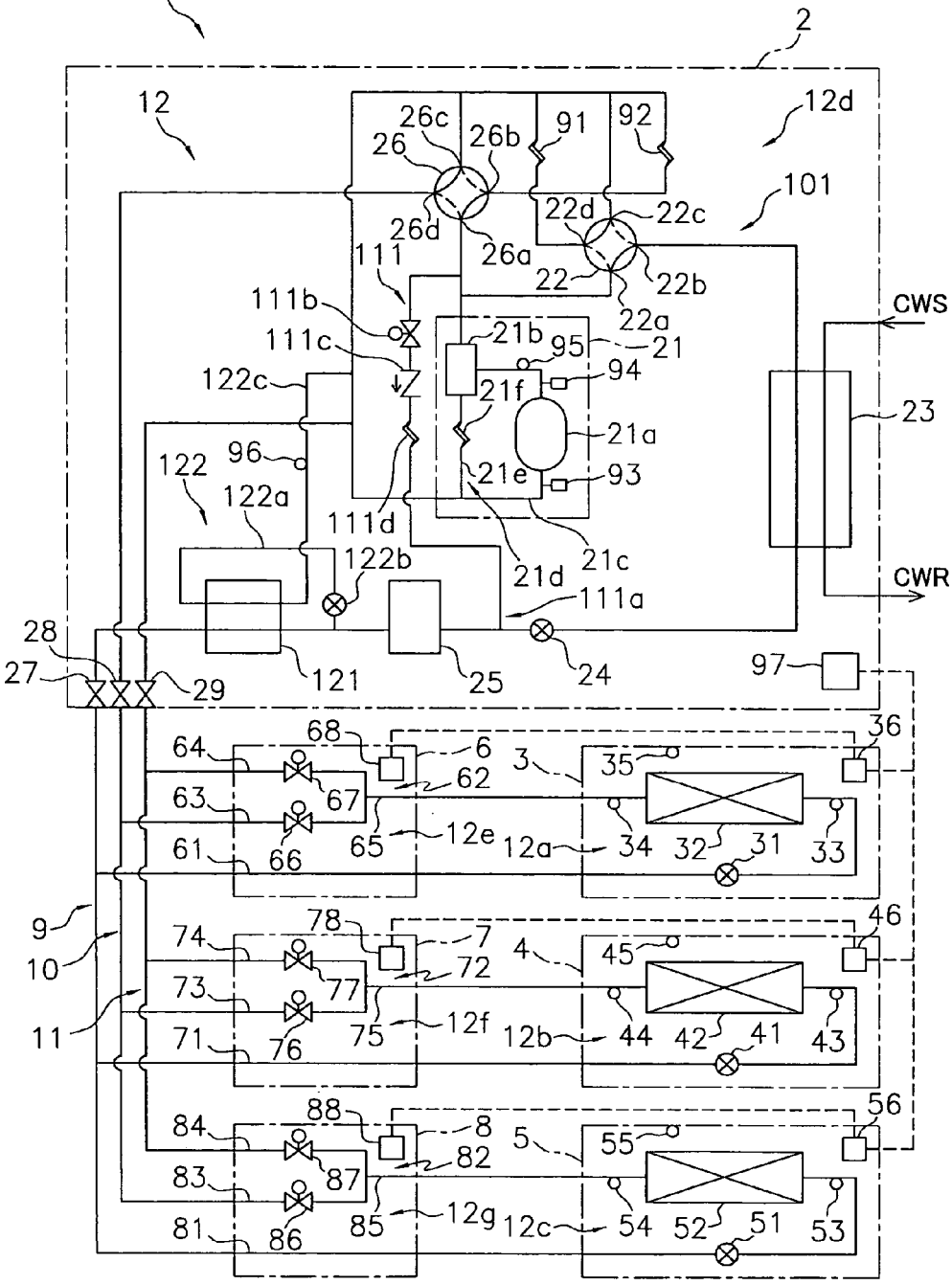

In the aforementioned air conditioner 1, the first oil returning circuit 101, the pressurizing circuit 111, the cooler 121 and the cooling circuit 122 were disposed in the heat source unit 2 in order to expand both the control width of the control of the evaporating ability of the heat source heat exchanger 23 with the heat source expansion valve 24 and the control width of the control of the condensing ability of the heat source heat exchanger 23 with the heat source expansion valve 24. However, when the control width of the control of the evaporating ability of the heat source heat exchanger 23 is ensured and it is necessary to expand only the control width of the control of the condensing ability of the heat source heat exchanger 23, for example, just the pressurizing circuit 111, the cooler 121 and the cooling circuit 122 may be disposed in the heat source unit 2 as shown in FIG. 11 (i.e., the first oil returning circuit 101 may be omitted).

(6) Modification 3

Figure 12:
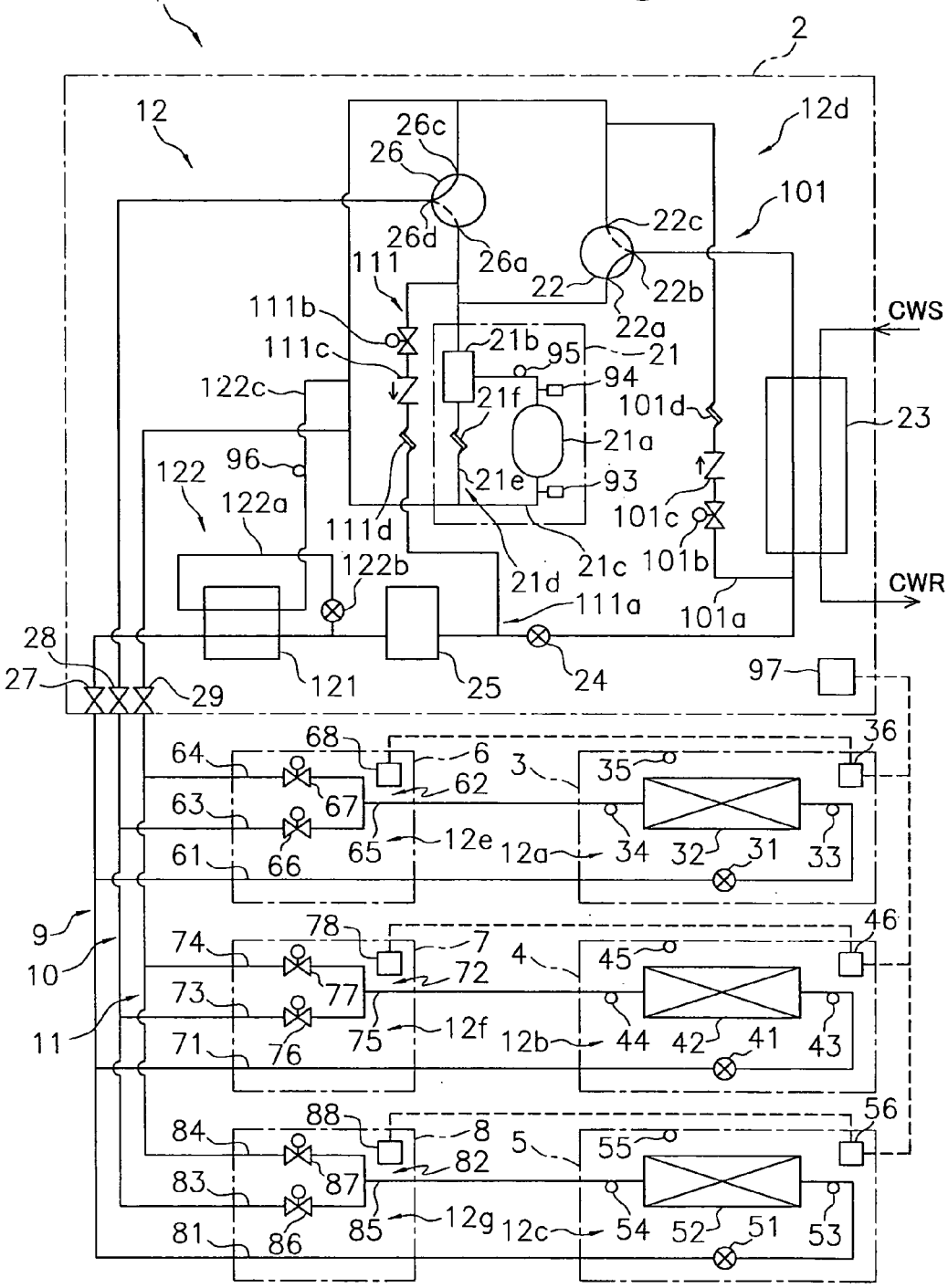

In the aforementioned air conditioner 1, four-way switch valves were used as the first switch mechanism 22 and the second switch mechanism 26, but the switch mechanisms are not limited thereto. For example, as shown in FIG. 12, three-way switch valves may also be used as the first switch mechanism 22 and the second switch mechanism 26.

(7) Modification 4

In the aforementioned air conditioner 1 (excluding modification 2), the flow rate of the refrigerating machine oil and the refrigerant returned to the compression mechanism 21 from the lower portion of the heat source heat exchanger 23 functioning as an evaporator through the first oil returning circuit 101 is determined in the first oil returning circuit 101 in accordance with the pressure loss between the lower portion of the heat source heat exchanger 23 functioning as an evaporator and the compression mechanism 21. For this reason, in cases where, for example, the pressure loss inside the heat source heat exchanger 23 functioning as an evaporator and inside the pipe from the refrigerant outlet side of the heat source heat exchanger 23 to the intake side of the compression mechanism 21 is small and the pressure loss in the first oil returning circuit 101 ends up becoming small, cases can arise where the refrigerating machine oil and the refrigerant of a flow rate sufficient enough to be able to prevent the refrigerating machine oil from accumulating inside the heat source heat exchanger 23 cannot be returned to the compression mechanism 21 from the lower portion of the heat source heat exchanger 23 through the first oil returning circuit 101.

Figure 13:
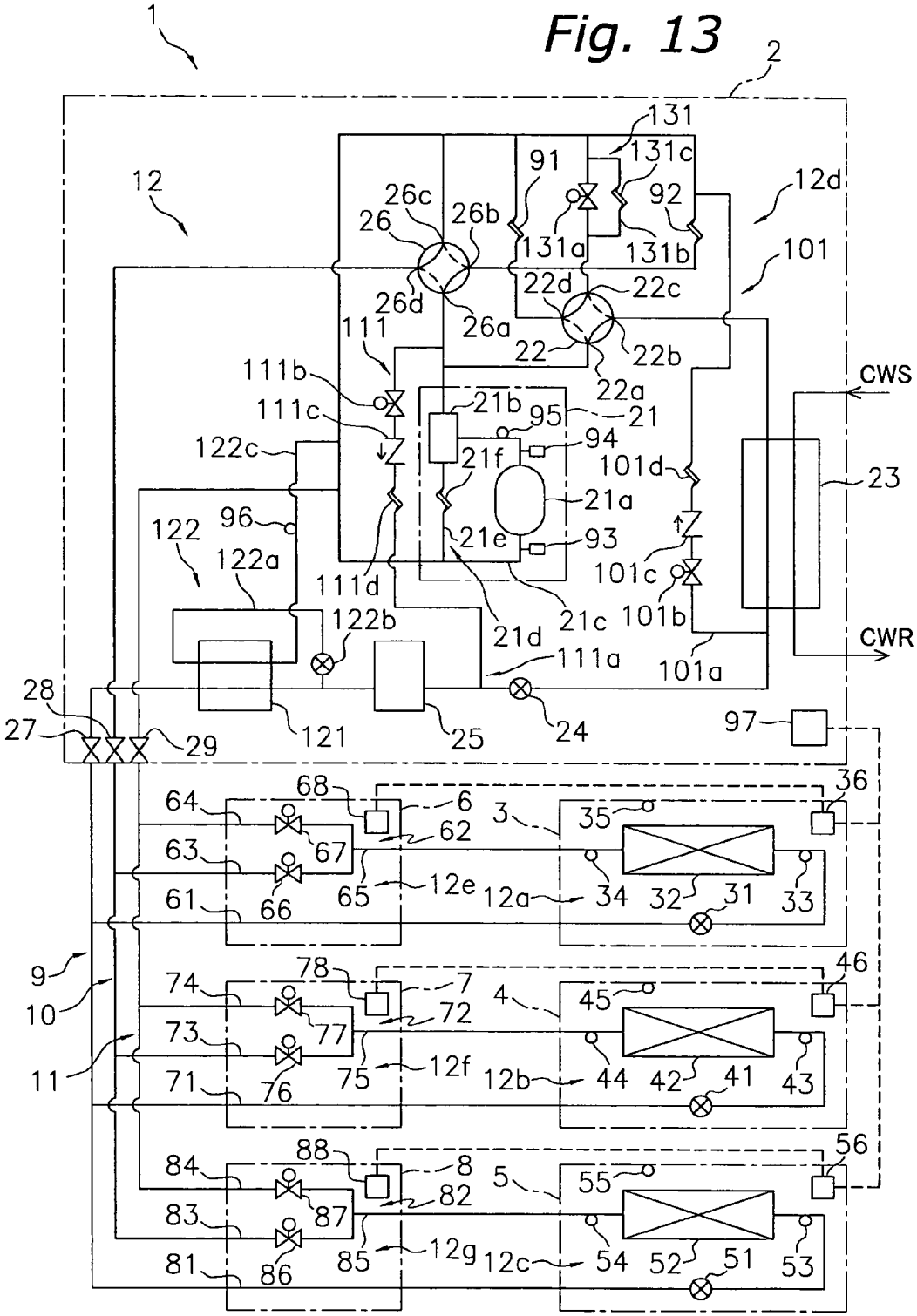

In such cases, in order to ensure that the refrigerating machine oil and the refrigerant of a flow rate sufficient enough to be able to prevent the refrigerating machine oil from accumulating inside the heat source heat exchanger 23 can be returned to the compression mechanism 21 from the lower portion of the heat source heat exchanger 23 through the first oil returning circuit 101, as shown in FIG. 13, the air conditioner 1 may be further disposed with a pressure reducing mechanism 131 that is connected between the refrigerant outlet side of the heat source heat exchanger 23 and the intake side of the compression mechanism 21 and can reduce, before the refrigerating machine oil and the refrigerant returned to the compression mechanism 21 from the lower portion of the heat source heat exchanger 23 through the first oil returning circuit 101 merge, the pressure of the gas refrigerant evaporated in the heat source heat exchanger 23 and returned to the intake side of the compression mechanism.

The pressure reducing mechanism 131 mainly comprises a control valve 131*a*, which comprises an electromagnetic valve connected to the pipe connecting the third port 22*c* of the first switch mechanism 22 and the intake side of the compression mechanism 21, and a bypass pipe 131*b*, which bypasses the control valve 131*a*. A capillary tube 131*c* is connected to the bypass pipe 131*b*. The pressure reducing mechanism 131 can be operated such that when the first oil returning circuit 101 is used, the control valve 131*a* is closed so that the gas refrigerant evaporated in the heat source heat exchanger 23 flows just through the bypass pipe 131*b*, and in other cases, the control valve 131*a* is opened so that the gas refrigerant evaporated in the heat source heat exchanger 23 flows through both the control valve 131*a* and the bypass pipe 131*b*. For this reason, when the first oil returning circuit 101 is used, the pressure loss from the refrigerant outlet side of the heat source heat exchanger 23 functioning as an evaporator to the intake side of the compression mechanism is increased, and the flow rate of the refrigerating machine oil and the refrigerant returned to the compression mechanism 21 from the lower portion of the heat source heat exchanger 23 through the first oil returning circuit 101 can be increased. Thus, the refrigerating machine oil and the refrigerant of a flow rate sufficient enough to be able to prevent the refrigerating machine oil from accumulating inside the heat source heat exchanger 23 can be returned to the compression mechanism 21 from the lower portion of the heat source heat exchanger 23 through the first oil returning circuit 101. It will be noted that the capillary tube 131*c* is not used when the pressure loss in the bypass pipe 131*b* can be appropriately set without connecting the capillary tube 131*c*.

Figure 14:
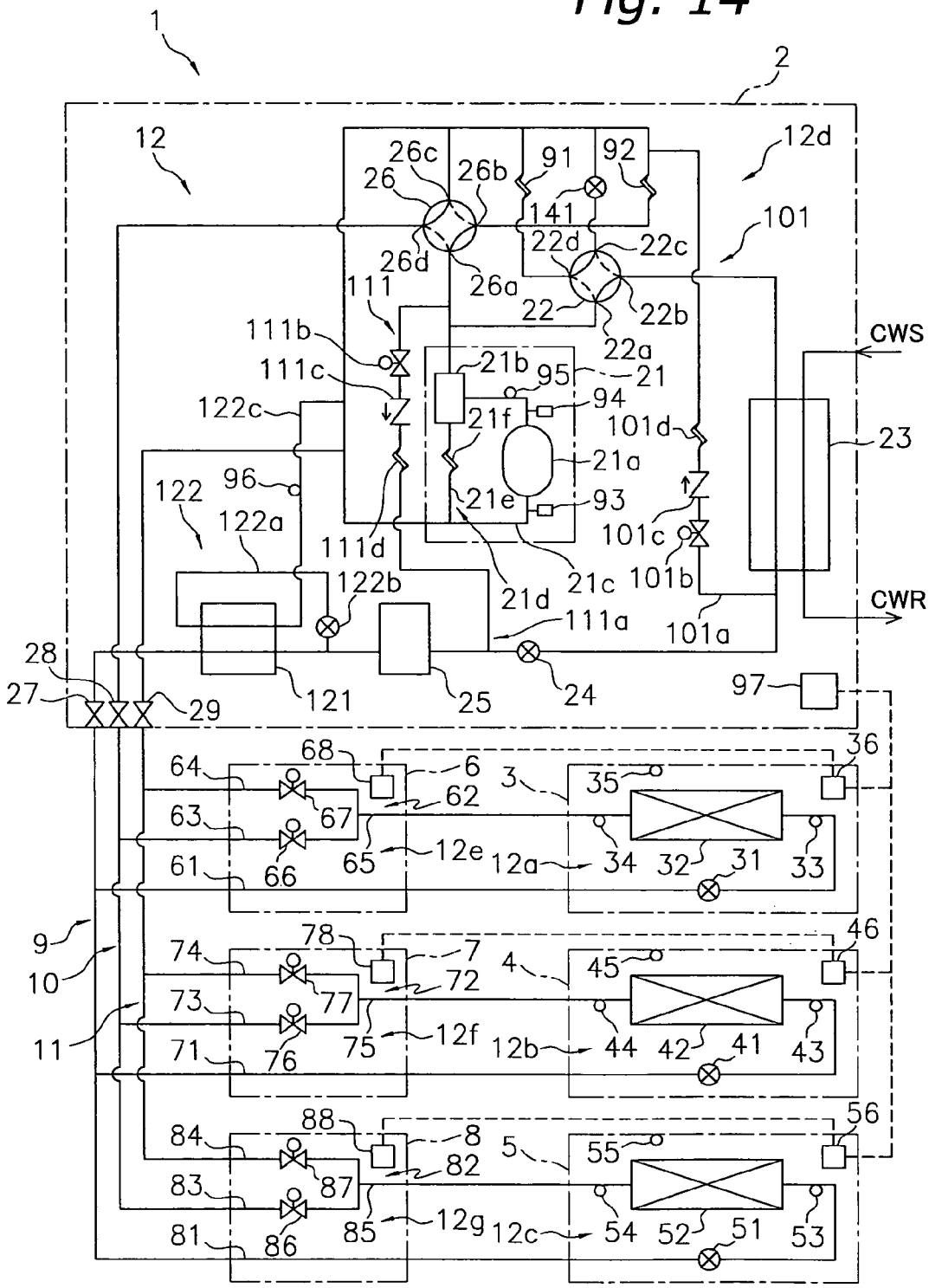

Further, rather than the control valve 131*a* and the bypass pipe 131*b* of the above-described pressure reducing mechanism 131, the pressure reducing mechanism may also be an electrically powered expansion valve connected to the pipe connecting the third port 22*c* of the first switch mechanism 22 and the intake side of the compression mechanism 21, as shown in FIG. 14. This pressure reducing mechanism 141 is configured such that when the first oil returning circuit 101 is used, control is conducted to reduce the opening, the pressure loss from the refrigerant outlet side of the heat source heat exchanger 23 functioning as an evaporator to the intake side of the compression mechanism 21 can be increased, and the flow rate of the refrigerating machine oil and the refrigerant returned to the compression mechanism 21 from the lower portion of the heat source heat exchanger 23 through the first oil returning circuit 101 can be increased, and such that in other cases, control can be conducted to increase the opening (i.e., completely open), so that the refrigerating machine oil and the refrigerant of a flow rate sufficient enough to be able to prevent the refrigerating machine oil from accumulating inside the heat source heat exchanger 23 can be reliably returned to the compression mechanism 21 from the lower portion of the heat source heat exchanger 23 through the first oil returning circuit 101.

INDUSTRIAL APPLICABILITY

By utilizing the present invention, the control width when the condensing ability of a heat source heat exchanger is controlled by a heat source expansion valve can be expanded in an air conditioner disposed with a heat source refrigerant circuit and utilization refrigerant circuits connected to the heat source refrigerant circuit.

What is claimed is:

1. An air conditioner comprising:

a heat source refrigerant circuit configured by an interconnection of a compression mechanism, a heat source heat exchanger, and a heat source expansion valve that reduces a pressure of refrigerant condensed in the heat source heat exchanger when the heat source heat exchanger functions as a condenser;

one or more utilization refrigerant circuits connected to the heat source refrigerant circuit and configured by the interconnection of a plurality of utilization heat exchangers and a plurality of utilization expansion valves;

a pressurizing circuit disposed in the heat source refrigerant circuit and configured to cause high-pressure gas refrigerant compressed in the compression mechanism to merge with a refrigerant having a pressure that is reduced in the heat source expansion valve, the refrigerant being sent to the utilization refrigerant circuits; and a cooler for cooling the refrigerant having the pressure that is reduced in the heat source expansion valve.

2. The air conditioner of claim 1, wherein the pressurizing circuit is connected between the heat source expansion valve and the cooler such that the high-pressure gas refrigerant merges.

3. The air conditioner of claim 1, further comprising p1 a cooling circuit connected to the heat source refrigerant circuit such that some of the refrigerant sent from the heat source heat exchanger to the utilization refrigerant circuits branches from the heat source refrigerant circuit and is introduced to the cooler, and the cooler cools the refrigerant having a pressure that is reduced in the heat source expansion valve, the refrigerant being sent to the utilization refrigerant circuits and thereafter the cooled refrigerant being returned to an intake side of the compression mechanism.

4. The air conditioner of claim 1, further comprising an oil returning circuit connected to a lower portion of the heat source heat exchanger and configured to return the refrigerating machine oil accumulating inside the heat source heat exchanger to the compression mechanism together with the refrigerant, the heat source heat exchanger functioning as an evaporator configured such that the refrigerant flows in from below and flows out from above, and a combination of refrigerating machine oil and refrigerant that does not separate into two layers in a temperature range of 30° C. or below being used.

5. The air conditioner of claim 2, further comprising a cooling circuit connected to the heat source refrigerant circuit such that some of the refrigerant sent from the heat source heat exchanger to the utilization refrigerant circuits branches from the heat source refrigerant circuit and is introduced to the cooler, and the cooler cools the refrigerant having a pressure that is reduced in the heat source expansion valve, the refrigerant being sent to the utilization refrigerant circuits and thereafter the cooled refrigerant being returned to an intake side of the compression mechanism.

6. The air conditioner of claim 2, further comprising an oil returning circuit connected to a lower portion of the heat source heat exchanger and configured to return the refrigerating machine oil accumulating inside the heat source heat exchanger to the compression mechanism together with the refrigerant, the heat source heat exchanger functioning as an evaporator configured such that the refrigerant flows in from below and flows out from above, and a combination of refrigerating machine oil and refrigerant that does not separate into two layers in a temperature range of 30° C. or below being used.

7. The air conditioner of claim 3, further comprising an oil returning circuit connected to a lower portion of the heat source heat exchanger and configured to return the refrigerating machine oil accumulating inside the heat source heat exchanger to the compression mechanism together with the refrigerant, the heat source heat exchanger functioning as an evaporator configured such that the refrigerant flows in from below and flows out from above, and a combination of refrigerating machine oil and refrigerant that does not separate into two layers in a temperature range of 30° C. or below being used.

8. The air conditioner of claim 5, further comprising an oil returning circuit connected to a lower portion of the heat source heat exchanger and configured to return the refrigerating machine oil accumulating inside the heat source heat exchanger to the compression mechanism together with the refrigerant, the heat source heat exchanger functioning as an evaporator configured such that the refrigerant flows in from below and flows out from above, and a combination of refrigerating machine oil and refrigerant that does not separate into two layers in a temperature range of 30° C. or below being used.

* * * * *

UNITED STATES PATENT AND TRADEMARK OFFICE

CERTIFICATE OF CORRECTION

PATENT NO. : 7,395,674 B2
APPLICATION NO. : 10/578674
DATED : July 8, 2008
INVENTOR(S) : Masahiro Honda It is certified that error appears in the above-identified patent and that said Letters Patent is hereby corrected as shown below:

Column 34,
Line 62, “claim 1, further comprising p1 a” should read -- claim 1, further comprising a --.

Signed and Sealed this

Third Day of February, 2009

JOHN DOLL
*Acting Director of the United States Patent and Trademark Office*